US011548682B2

(12) United States Patent
Su

(10) Patent No.: US 11,548,682 B2
(45) Date of Patent: Jan. 10, 2023

(54) FOLDING BOX

(71) Applicant: SHANGHAI HONGYAN RETURNABLE TRANSIT PACKAGINGS CO., LTD., Shanghai (CN)

(72) Inventor: Yongping Su, Shanghai (CN)

(73) Assignee: SHANGHAI HONGYAN RETURNABLE TRANSIT PACKAGINGS CO., LTD., Shanghai (CN)

( * ) Notice: Subject to any disclaimer, the term of this patent is extended or adjusted under 35 U.S.C. 154(b) by 106 days.

(21) Appl. No.: 16/604,295

(22) PCT Filed: Mar. 21, 2018

(86) PCT No.: PCT/CN2018/079795
§ 371 (c)(1),
(2) Date: Oct. 10, 2019

(87) PCT Pub. No.: WO2018/188461
PCT Pub. Date: Oct. 18, 2018

(65) Prior Publication Data

US 2020/0039683 A1 Feb. 6, 2020

(30) Foreign Application Priority Data

Apr. 10, 2017 (CN) ..... 201710229768.X

(51) Int. Cl.
*B65D 6/18* (2006.01)
*B65D 21/02* (2006.01)

(52) U.S. Cl.
CPC ..... *B65D 11/1833* (2013.01); *B65D 21/0228* (2013.01); *B65D 21/0209* (2013.01); *B65D 21/0223* (2013.01)

(58) Field of Classification Search
CPC ..... B65D 11/1833; B65D 21/0226; B65D 21/0228; B65D 21/0209; B65D 21/0223
(Continued)

(56) References Cited

U.S. PATENT DOCUMENTS 5,671,857 A * 9/1997 Stromberg ..... B65D 1/225 206/505
5,967,356 A * 10/1999 Laarhoven ..... B65D 11/1833 220/6

(Continued)

FOREIGN PATENT DOCUMENTS

CN 1332689 A 1/2002
CN 2815902 Y 9/2006

(Continued)

OTHER PUBLICATIONS

International Search Report (Chinese and English) and Written Opinion issued in PCT/CN2018/079795, dated May 21, 2018, total 12 pages.

(Continued)

*Primary Examiner* — Rafael A Ortiz
*Assistant Examiner* — Sanjidul Islam
(74) *Attorney, Agent, or Firm* — Hamre, Schumann, Mueller & Larson, P.C.

(57) ABSTRACT

A base is provided with a plate-shaped body and two pairs of opposite protrusion edges surrounding the periphery of the plate-shaped body. The two pairs of opposite side plates are hinged to the protrusion edges of the base and are foldable relative to the base. Connecting parts are arranged at the bottom of the side plate, and corresponding base hinging parts are arranged on the protrusion edge of the base, where the connecting parts are hinged to the base hinging parts respectively, thus hinging the side plate to the base. At least one pair of the two pairs of opposite protrusion (Continued)

edges are provided with first closed cavities extending along the length direction of the protrusion edges, and/or the plate-shaped body is provided with second closed cavities, where the second closed cavities protrude from the main surface of the plate-shaped body.

16 Claims, 22 Drawing Sheets

(58) Field of Classification Search
USPC ..... 220/4.28, 4.29, 6
See application file for complete search history.

(56) References Cited

U.S. PATENT DOCUMENTS

| | | | | |
|---|---|---|---|---|
| 7,100,786 | B2 * | 9/2006 | Smyers | B65D 11/1833 220/6 |
| 8,640,912 | B2 * | 2/2014 | Orgeldinger | B65D 11/1833 220/691 |
| 2002/0108951 | A1 | 8/2002 | Zelko | |
| 2007/0210083 | A1 * | 9/2007 | Li | B65D 11/1833 220/6 |
| 2015/0060442 | A1 | 3/2015 | Liu et al. | |

FOREIGN PATENT DOCUMENTS

| | | | | |
|---|---|---|---|---|
| CN | 201284040 | Y | | 8/2009 |
| CN | 105836254 | A | | 8/2016 |
| CN | 105905394 | A | | 8/2016 |
| CN | 106956845 | A | | 7/2017 |
| CN | 206766569 | U | | 12/2017 |
| DE | 29702706 | U1 | | 4/1997 |
| JP | 2002104405 | A | * | 4/2002 |
| JP | 2002332035 | A | | 11/2002 |
| JP | 2003312659 | A | | 11/2003 |
| JP | 2004042997 | A | | 2/2004 |
| JP | 2004051115 | A | | 2/2004 |
| JP | 2004090999 | A | * | 3/2004 |
| JP | 2004284662 | A | * | 10/2004 |
| JP | 2020104405 | A | | 7/2020 |
| KR | 20010105292 | A | | 11/2001 |
| WO | 9739954 | A1 | | 10/1997 |
| WO | 2010119068 | A1 | | 10/2010 |

OTHER PUBLICATIONS

The Extended European search report issued in EP18783632, dated Mar. 12, 2021.
Notice of Reasons for Refusal issued in JP2020-504756, dated Nov. 24, 2020, with English machine translation.
Patent Examination Report issued in New Zealand Application No. 758672, dated Nov. 19, 2020.
Supplementary Partial European Search Report issued in EP18783632, dated Nov. 19, 2020.

* cited by examiner

FOLDING BOX

CROSS REFERENCE TO RELATED APPLICATIONS

This application claims the priority of the Chinese application No. 201710229768.X, titled "Folding Box" filed on Apr. 10, 2017, the contents of which are incorporated by reference herein.

TECHNICAL FIELD

This invention relates a container, in particular a folding box.

TECHNICAL BACKGROUND

When the prior folding box is used, the side plates are unfolded and erected, and four side plates are interlocked with each other, so as to form a relatively closed room to accommodate goods. After the goods are emptied, the folding box can be recycled. In order to reduce cost, the side plates are folded, so that more boxes can be accommodated in the same place. During the recycling process, it should be convenient to clean the box, especially when the folding box is used for loading fresh food such as vegetables and fruits, the cleaning is especially important after use. Meanwhile, when the box is in use, it should be ensured that the box is safe and reliable when goods loaded in the box body, and the side plate can be to be unlocked and folded simply and quickly when goods in the box body are emptied.

The prior folding box, for example, as disclosed in U.S. Pat. No. 7,100,786B2, has a box body structure composed of thin walls and reinforcing ribs arranged on the surface of the thin walls, and the structure of the base hinge mounting position is single layered and weak due to the elastic installation requirements. The base is formed with many molded non-closed cavities, dirt can be easily remained when the concave parts of the grid ribs are rapidly cleaned, and cleaning efficiency is very low. Particularly, at the protrusion edge position of the base, due to assembling to hinges of the side plates and base forming, a large amount of deep cavities are remained in the base, a large amount of sewage can flow into these areas during cleaning and is not easy to discharge, and bacteria are easy to breed.

In addition, the thin-wall structure is weak in the bending-resistance and compression-resistance, and particularly, at the position where the side plate is hinged to the base, a single layered thin wall is connected with the side plate and the hinge. Especially when the box bears high-density goods, the inner surface of the base is depressed and recessed downwardly, and at the moment, the side plate is hinged to the protrusion edge of the base with its hinge, the protrusion edge will bend inwards along with the recessing of the base, and one side close to the hinge of the side plate is also randomly pulled by the protrusion edge and deforms and bends inwardly and downwardly. Thus, in the prior folding box, the part of the side plates close to the hinges can not stand the deformation caused by inward bending of the protrusion edge when the load is increased, so that the base of the box is more prone to recess, causing the further inward bending of the protrusion edge bend and thus inward deformation of the side plates. When the layers of boxes are stacked, the goods in the upper layer will sink along with the deformation of the thin wall base, so that the goods in the lower layer will be pressed, so that the goods subject to potential safety hazards to a certain extent; when the boxes are repeatedly used, fatigue damage will be caused by stress deformation due to frequent switching between high and low temperature environments, and the service life of the boxes is shortened.

SUMMARY

The invention aims to provide a folding box which is high in strength and easy to use and clean.

In order to achieve the above aim, according to one aspect of this invention, it is provided a folding box, comprising a base and two pairs of opposite side plates, the base is provided with a plate-shaped body and two pairs of opposite protrusion edges surrounding the periphery of the plate-shaped body, the two pairs of opposite side plates are hinged to the protrusion edges of the base and are foldable relative to the base, wherein connecting parts are arranged at the bottom of the side plate, and corresponding base hinging parts are arranged on the protrusion edges of the base, wherein the connecting parts are hinged to the base hinging parts for hinging the side plate to the base; and at least one pair of the two pairs of opposite protrusion edges are provided with first closed cavities extending along the length direction of the protrusion edges.

In one embodiment, a plurality of connecting parts extend from the bottom of the side plate and are spaced apart from each other, and each of the connecting parts is provided with side plate engaging parts; and the protrusion edge of the base is provided with base engaging parts, wherein the base engaging parts are arranged so that when the side plate is hinged to the base, the engaging parts of the base are engaged with the engaging parts of the side plate respectively.

In one embodiment, a pocket is formed in a position corresponding to the connecting part of the protrusion edge of the base, the base engaging part is arranged in the pocket, and the side plate engaging part is arranged such that the side plate engaging part is rotatable around the base engaging part during the side plate is folding relative to the base.

In one embodiment, the bottom of the side plate is further provided with first side plate limiting parts, and first base limiting parts are arranged at positions corresponding to the first side plate limiting parts on the base, wherein the first side plate limiting part is engagable with the first base limiting part to prevent the side plate from turning outwards when the side plate is in upright state.

In one embodiment, the plate-shaped body is provided with second closed cavities, and the second closed cavities protrude from the main surface of the plate-shaped body.

In one embodiment, the second closed cavities are arranged on the main surface of the plate-shaped body opposite to the protrusion edges.

In one embodiment, the plate-shaped body is provided with at least two second closed cavities parallel to one protrusion edge.

In one embodiment, two pairs of opposite second closed cavities are arranged on the periphery of the base.

In one embodiment, two intersected second closed cavities are arranged in the base, and the intersection point of the two second closed cavities are located in the center of the base.

In one embodiment, the bottom of the side plate is internally provided with a third closed cavity extending along the length direction of the side plate.

In one embodiment, the ends of each of the second closed cavities extend to the edge of the base.

In one embodiment, a plurality of connecting parts extend from the bottom of the side plate and are spaced apart from each other, and each of the connecting parts is provided with side plate engaging part; pockets are formed in the protrusion edge of the base at positions corresponding to the connecting parts, a base engaging part is arranged in the middle of the pocket, and hinge shaft receiving parts are arranged at the two ends of the pocket, wherein the base engaging part is arranged so that when the side plate is hinged to the base, the base engaging part is engaged with the side plate engaging part, and the side plate engaging part is arranged such that when the side plate is folding relative to the base, the side plate engaging part is rotatable around the base engaging part; and the bottom of the side plate is further provided with a first side plate limiting part, and a first base limiting part is arranged at a position corresponding to the first side plate limiting part on the base, wherein the first side plate limiting parts are engageable with the first base limiting part to prevent the side plate from turning outwards when the side plate is in upright state.

In one embodiment, the plate-shaped body is 3 mm~5 mm in thickness.

In one embodiment, side plate limiting parts are provided on the top of the side plate, base limiting parts are provided on the bottom of the base, wherein the side plate limiting parts and the base limiting parts are arranged such that when the two folding boxes are stacked, the base limiting parts of the upper folding box cooperates with the side plate limiting parts of the lower folding box, thereby the relative position between the base of the upper folding box and the side panel of the lower folding box is fixed According to another aspect of this invention, there provides a folding box, comprising a base and two pairs of opposite side plates, the base is provided with a plate-shaped body and two pairs of opposite protrusion edges surrounding the periphery of the plate-shaped body, the two pairs of opposite side plates are hinged to the protrusion edges of the base and are foldable relative to the base, wherein, connecting parts are arranged at the bottom of the side plate, and corresponding base hinging parts are arranged on the protrusion edges of the base, wherein the connecting parts are hinged to the base hinging parts for hinging the side plate to the base; and the plate-shaped body is provided with a closed cavity, and the closed cavity protrudes from the main surface of the plate-shaped body.

In one embodiment, the closed cavity is arranged on the main surface of the plate-shaped main body opposite to the protrusion edge.

In one embodiment, the plate-shaped body is provided with at least two second closed cavities parallel to one protrusion edge.

In one embodiment, two pairs of opposite closed cavities are arranged on the periphery of the plate-shaped body.

In one embodiment, two intersected closed cavities are arranged in the base, and the intersection point of the two closed cavities are located in the center of the base.

In one embodiment, the ends of the closed cavities extend to the protrusion edge of the base In one embodiment, a plurality of through holes are distributed in the plate-shaped body.

In one embodiment, the plate-shaped body is 3 mm~5 mm in thickness.

In one embodiment, a plurality of connecting parts extend from the bottom of the side plate and are spaced apart from each other, and each of the connecting parts is provided with side plate engaging part; and the protrusion edge of the base is provided with base engaging parts, wherein the base engaging parts are arranged so that when the side plate is hinged to the base, the engaging parts of the base are engaged with the engaging parts of the side plate respectively.

In one embodiment, a pocket is formed in a position corresponding to the connecting part of the protrusion edge of the base, the base engaging part is arranged in the pocket, and the side plate engaging part is arranged such that the side plate engaging part is rotatable around the base engaging part during the side plate is folding relative to the base.

In one embodiment, the bottom of the side plate is further provided with a first side plate limiting part, and a first base limiting part is arranged at a position corresponding to the first side plate limiting part on the base, wherein the first side plate limiting parts are engageable with the first base limiting part to prevent the side plate from turning outwards when the side plate is in upright state.

In one embodiment, side plate limiting parts are provided on the top of the side plate, and base limiting parts are provided on the bottom of the base, wherein the side plate limiting parts and the base limiting parts are arranged such that when the two folding boxes are stacked, the base limiting parts of the upper folding box cooperates with the side plate limiting parts of the lower folding box, thereby the relative position between the base of the upper folding box and the side panel of the lower folding box is fixed.

In one embodiment, the closed cavities in the base are arranged such that when two folding boxes are stacked one on another, and the closed cavities of the upper folding box located inside of the side plate of the below folding box.

According to another aspect of this invention, there provides a folding box, comprising a base and two pairs of opposite side plates, the two pairs of opposite side plates are hinged to the protrusion edges of the base and are foldable relative to the base, wherein a plurality of connecting parts are spaced apart from each other extend from the bottom of the side plate, and the connecting part is provided with a side plate engaging part;

pockets are formed in positions corresponding to the connecting part of the protrusion edge of the base, a base engaging part is arranged in the middle of the pocket, wherein the base engaging part is arranged so that when the side plate is hinged to the base, the base engaging part is engaged with the side plate engaging part, and the side plate engaging part is arranged such that when the side plate is folding relative to the base, the side plate engaging part are rotatable around the base engaging part; and the bottom of the side plate is further provided with a first side plate limiting part, and a first base limiting part is arranged at a position corresponding to the first side plate limiting part on the base, wherein the first side plate limiting parts are engageable with the first base limiting part to prevent the side plate from turning outwards when the side plate is in an upright state.

In one embodiment, the base engaging parts extend upward from the bottom surface of the pocket and are spaced apart from the side surface facing the inside of the folding box of the pocket.

Preferably, the pocket opens to the top and the inside of the protrusion edge.

In one embodiment, the side plate engaging part extend integrally from one side of the connecting part along the length direction of the side plate.

In one embodiment, the first side plate limiting part is a rib extending from one side opposite to the side plate engaging part of the connecting part in the length direction of the side plate, and the first base limiting part is an open slot with an opening facing upward formed in the pocket.

In one embodiment, at least one side plate engaging part is further provided with a second side plate limiting part, and at least one base engaging part is provided with a second base limiting part at a position corresponding to the second side plate limiting part, wherein the second side plate limiting part is engaged with the second base limiting part when the side plate is in a folded state, so as to prevent the engaging part of the side plate from being disengaged upward from the engaging part of the base.

Preferably, the second side plate limiting part is a portion of the side plate engaging part, and the second base limiting part is a protrusion protruding from one side of the upper portion of the base engaging part, wherein when the side plate is in folded state, the engaging part of the side plate is located below the engaging part of the base.

In one embodiment, the second base limiting part is located between the base engaging part and the side surface of the pocket which faces the inner side of the folding box.

In another embodiment, the folding box further comprises a third side plate limiting part, the third side plate limiting part is arranged such that when the side plate is in folded state, the third side plate limiting part is engaged with the base engaging part to prevent the side plate from being disengaged from the base in the direction towards the interior of the folding box.

In one embodiment, the third side plate limiting part extends integrally from the side plate engaging part along the extending direction of the side plate engaging part.

Preferably, the folding box further comprises a third side plate limiting part and a third base limiting part, the third side plate limiting part is arranged such that when the side plate is in folded state, the third base limiting part is engaged with the side plate limiting part to prevent the side plate from being disengaged from the base in the direction towards the interior of the folding box.

In one embodiment, the third side plate limiting part is a protrusion protruding from the outer side of the connecting part, the third base limiting part is a groove in the pocket, and the protrusion is located in the groove when the side plate is in folded state.

In one embodiment, each connecting part in every two adjacent connecting parts is provided with one side plate engaging part, and each pocket is provided with two base engaging parts, wherein the engaging parts of the two adjacent connecting parts are respectively engaged with the two base engaging parts, and when the side plates are folding relative to the base, the two adjacent connecting parts are rotatable around the two base engaging parts respectively.

Preferably, the engaging parts of the two adjacent connecting parts extend toward each other from respective connecting parts respectively.

Preferably, the two base engaging parts together form a T-shaped structure.

In another embodiment, hinge shafts extending along the length direction of the side plate are provided on the outer side of the side plate engaging part, and hinge shaft receiving parts are arranged at the two ends of the pocket of the base, wherein the hinge shafts are received in the hinge shaft receiving parts and are rotatable around an axis in the hinge shaft receiving parts.

Preferably, a positioning portion extends from the outer end of the hinge shaft along the axial direction of the hinge shaft, a limiting hanging shoulder is formed at each side of the pocket in the base, wherein the positioning portion engages with the hanging shoulder when the side plate is in an upright state.

Preferably, a limiting rod is connected to between two side plate engaging parts, a limiting protrusion facing the inner side of the folding box is arranged on the side surface of the pocket of the base which faces the inner side of the folding box, wherein the limiting rod cooperates with the limiting protrusion to prevent the side plate from being disengaged from the base when the side plate is in folded state.

Preferably, the limiting rod further provided with a side plate installation guide part to assist the installation of the side plate.

In one embodiment, a cavity extending along the extending direction of the protrusion edge is arranged in the protrusion edge of the base.

Preferably, the cavity is a closed cavity.

According to another aspect of this invention, there provides a folding box, wherein the two pairs of opposite side plates are hinged to the protrusion edges of the base and are foldable relative to the base, the base having a plate-shaped body and two pairs of opposite protrusion edges surrounding the periphery of the plate-shaped body, wherein a plurality of connecting parts are spaced apart from each other extend from the bottom of the side plate, and at least one side plate engaging part is arranged at each of two adjacent connecting parts;

pockets are formed in the protrusion edge of the base at positions corresponding to the connecting parts, and at least two base engaging parts are arranged in each pocket, wherein the base engaging part is arranged so that when the side plate is hinged to the base, and the base engaging part is engaged with the corresponding side plate engaging part, and the side plate engaging part is arranged such that the side plate engaging part is rotatable around the base engaging part during the side plate is folding relative to the base; and the bottom of the side plate is further provided with first side plate limiting parts, and first base limiting parts are arranged at positions corresponding to the first side plate limiting part on the base, wherein the first side plate limiting parts are engagable with the first base limiting parts respectively to prevent the side plate from turning outwards when the side plate is in upright state.

In one embodiment, at least one pair of the two pairs of opposite protrusion edges are provided with first closed cavities extending along the length direction of the protrusion edge, and/or the plate-shaped body is provided with a second closed cavity, and the second closed cavity protrudes from the main surface of the plate-shaped body.

In one embodiment, one side plate engaging part extends from one side of each connecting part, two base engaging parts are arranged in each pocket, and the two base engaging parts together form a T-shaped structure.

Preferably, the engaging parts of the two adjacent connecting parts extend toward each other from respective connecting parts respectively.

Preferably, the first side plate limiting part is a rib extending from one side opposite to the side plate engaging part of the connecting part in the length direction of the side plate, and the first base limiting part is an open slot with an opening facing upward formed in the pocket.

According to yet another aspect of this invention, there provides a folding box, comprising a base and two pairs of opposite side plates, wherein the two pairs of opposite side plates are hinged to the protrusion edges of the base and are foldable relative to the base, the base having a plate-shaped body and two pairs of opposite protrusion edges surrounding the periphery of the plate-shaped body, wherein a plurality of connecting parts extend from the bottom of the side plate and are spaced apart from each other, and each of the connecting parts is provided with side plate engaging parts;

pockets are formed in positions corresponding to the connecting part of the protrusion edge of the base, base engaging parts are arranged in the middle of the pocket, wherein the base engaging part is arranged so that when the side plate is hinged to the base, the base engaging part is engaged with the side plate engaging part, and the side plate engaging part is arranged such that when the side plate is folding relative to the base, the side plate engaging part are rotatable around the base engaging part;

the bottom of the side plate is further provided with a first side plate limiting part, and a first base limiting part is arranged at a position corresponding to the first side plate limiting part on the base, wherein the first side plate limiting parts are engageable with the first base limiting part to prevent the side plate from turning outwards when the side plate is in upright state; and a first cavity extending along the length direction of the side plate is arranged inside the bottom protrusion edge of the side plate, and a second cavity extending along the extending direction of the protrusion edge is formed in the protrusion edge of the base.

Preferably, the first cavity and the second cavity are closed cavities.

According to yet another aspect of this invention, there provides a folding box, comprising a base and two pairs of opposite side plates, wherein the two pairs of opposite side plates are hinged to the protrusion edges of the base and are foldable relative to the base, the base having a plate-shaped body and two pairs of opposite protrusion edges surrounding the periphery of the plate-shaped body, wherein a plurality of connecting parts are spaced apart from each other extend from the bottom of the side plate, and the connecting part is provided with a side plate engaging part, and hinge shafts extending along the length direction of the side plate are provided on the outer side of the side plate engaging part;

pockets are formed in the protrusion edge of the base at positions corresponding to the connecting parts, a base engaging part is arranged in the middle of the pocket, and hinge shaft receiving parts are arranged at the two ends of the pocket, wherein the base engaging part is arranged so that when the side plate is hinged to the base, the base engaging part is engaged with the side plate engaging part, and the side plate engaging part is arranged such that when the side plate is folding relative to the base, the side plate engaging part is rotatable around the base engaging part, and the hinge shaft is received in the hinge shaft receiving part and is rotatable around an axis in the hinge shaft receiving part; and the bottom of the side plate is further provided with a first side plate limiting part, and a first base limiting part is arranged at a position corresponding to the first side plate limiting part on the base, wherein the first side plate limiting parts are engageable with the first base limiting part to prevent the side plate from turning outwards when the side plate is in upright state.

Preferably, a positioning portion extends from the outer end of the hinge shaft along the axial direction of the hinge shaft, a limiting hanging shoulder is formed at each side of the pocket in the base, wherein the positioning portion engages with the hanging shoulder when the side plate is in an upright state.

In one embodiment, a side surface of the pocket of the base which faces the inner side of the folding box is provided with a limiting protrusion facing the inner side of the folding box, wherein the limiting rod cooperates with the limiting protrusion to prevent the side plate from being disengaged from the base when the side plate is in folded state.

In one embodiment, at least one pair of the two pairs of opposite protrusion edges are provided with first closed cavities extending along the length direction of the protrusion edge, and/or the plate-shaped body is provided with a second closed cavity, and the second closed cavity protrudes from the main surface of the plate-shaped body.

The folding box of present application is high in strength and easy to clean.

EMBODIMENTS

Figure 1:
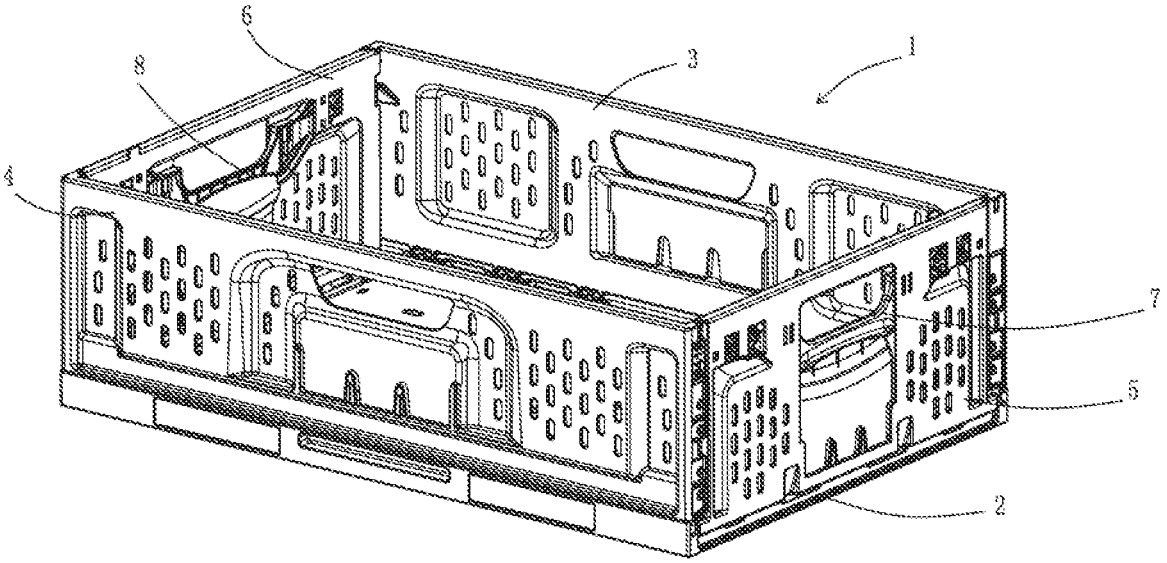
FIG. 1 is a perspective view of a folding box according to one embodiment of this invention, wherein the folding box is in upright state.

The preferred embodiment of the present invention will be described in detail with reference to the accompanying drawings, so that the objects, features and advantages of the present invention can be understood more clearly. it should be understood that the embodiments shown in the drawings are not intended to limit the scope of the invention, but merely illustrate the gist of the technical solutions of the present invention.

FIG. 1 shows the folding box according to this invention. As shown in FIG. 1, the folding box 1 includes a base 2, a pair of opposite long side plates 3 and 4 as well as a pair of opposite short side plates 5 and 6. The side plates are hinged and foldable to the base 2. During folding, the short side plates are folded firstly, then the long side plates are folded on the short side plates. Two sides of each side plate are provided with engaging parts, adjacent sides of adjacent side plates are engaged with each other through the engaging parts. The short side plates 5 and 6 are further provided with locking devices 7 and 8 for locking adjacent long and short side plates with each other. The engaging parts at two sides of side plates and the locking devices 7 and 8 can employ any known or to be developed structure in this art and are not described in detail herein.

Figure 2:
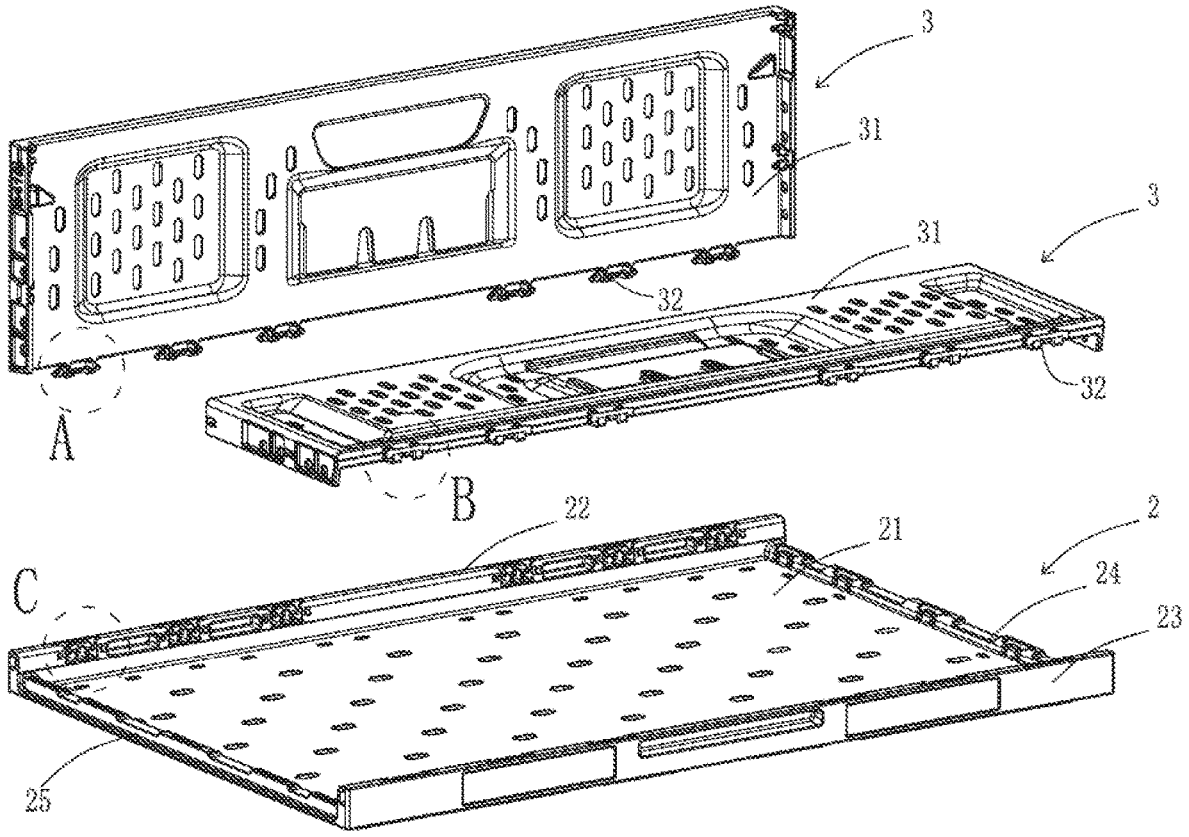
FIG. 2 is an exploded perspective view of the folding box of FIG. 1, wherein only one base and one long side plate are shown in two different views for sake of clarity.
Figure 3A:
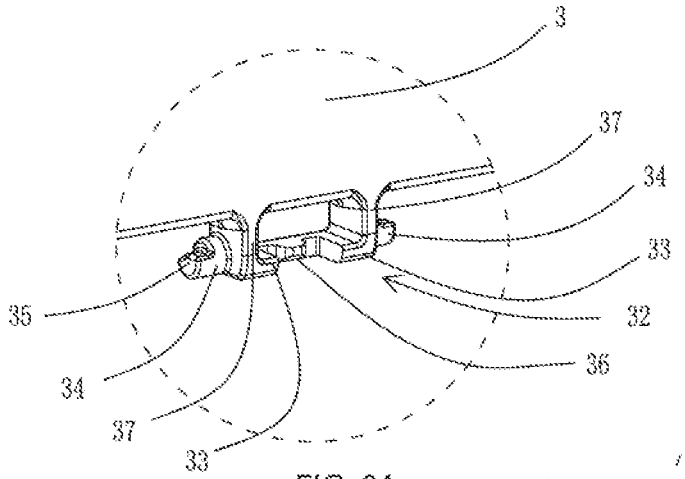
FIGS. 3A-3C are enlarged views showing parts A, B and C in FIG. 2 respectively.
Figure 3B:
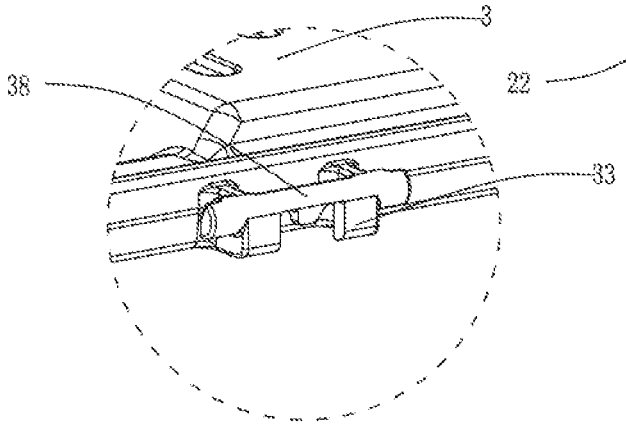
Figure 3C:
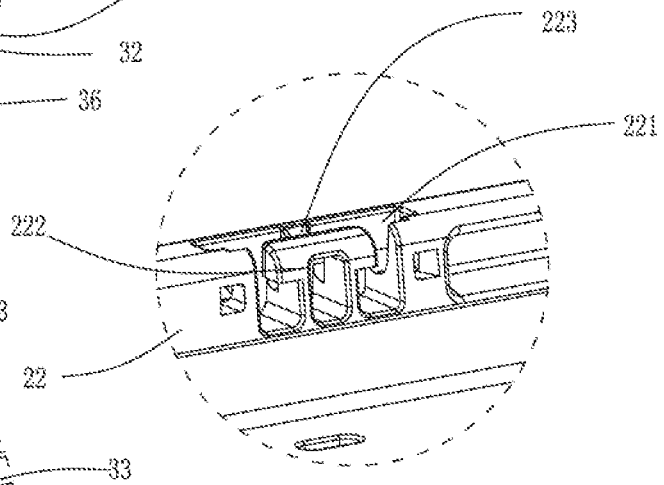
Figure 4A:
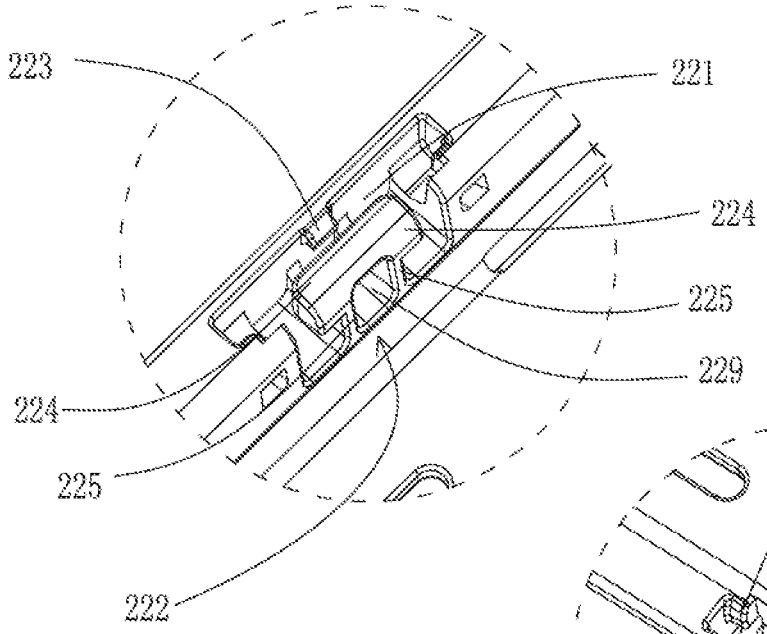
FIG. 4A is a schematic view of one part of the base of the folding box in FIG. 1, showing the structure of the part connecting to a side plate of the base.
Figure 4B:
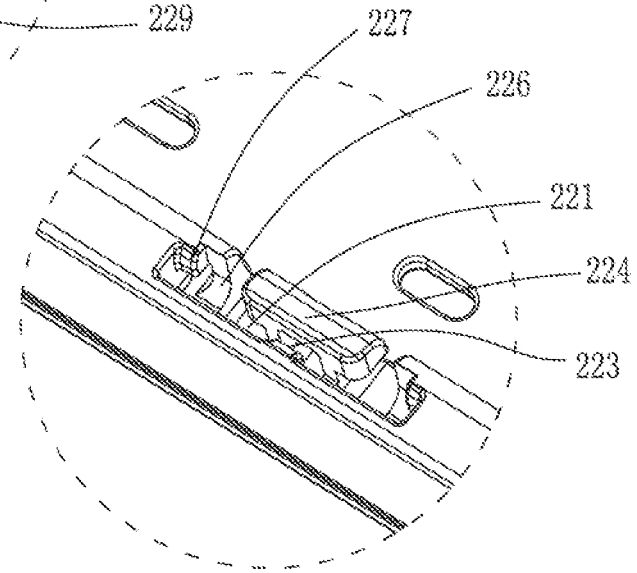
FIG. 4B is a schematic view of one part of the base of the folding box in FIG. 1, showing the structure of the part connecting to a side plate of the base in a different view.

FIG. 2 to FIG. 4B show the structure of the connecting part between the side plates and the base according to one embodiment of this invention. FIG. 2 to FIG. 4B only show the connecting structure on the long side plates 3 and 4, the connecting structure on the short side plates 5 and 6 is substantially the same and is not described again in detail herein. As shown in FIGS. 2-3C, the long side plate 3 includes a body 31. A plurality of connecting parts 32 extend from the bottom of the long side plate and are spaced apart from each other. Each connecting part 32 is provided with side plate engaging parts 33. In particular, each connecting part is provided with two ribs 37 integrally extending from the bottom of the long side plate and are spaced apart from each other. Two side plate engaging parts 33 extend oppositely from inside of the bottom of two ribs 37 along the length direction of the long side plate 3. A connecting rod, or limiting rod, 38 is connected to two side plate engaging parts 33 and mainly functions as a limiting rod to prevent the side plate from being disengaged from the base in the folded state, which will be described further below. The connecting rod 38 is also formed with a guiding part 36 in the middle thereof for guiding the long side plate when mounting the long side plate to the base. Two hinge shafts 34 extend from the outer sides of the two ribs 37 in opposite directions along the longitudinal direction of the long side plate 3 respectively. A positioning portion 35 extends from the outer end of the hinge shaft 34 along the axial direction of the hinge shaft, wherein the positioning portion 35 engages with the hanging shoulder on the base in a state where the side plate is upright, which will be further described below. Here, the positioning portion 35 can be formed by removing a part of the end of the hinge shaft 34, that is, the positioning portion 35 is formed by the end of the hinge shaft.

The base 2 includes a body 21. The body 21 is provided with a pair of opposite protrusion edges 22 and 23 and the other pair of opposite protrusion edges 24 and 25 on the periphery thereof. A pair of opposite long side panels 3 and 4 are mounted to the protrusion edges 22 and 23 respectively, and a pair of opposite short side panels are mounted to the protrusion edges 24 and 25 respectively. Each protrusion edge is provided with a structure for mating with a corresponding structure on the bottom (i.e., the lower side) of the side panel. Here, a base structure mating with a corresponding structure on the lower side of the long side plate 3 on the protrusion edge 22 is taken as an example for illustration. The corresponding structures on the protrusion edges 24 and 25, that is, the structures mating with the corresponding structures on the lower side of the short side panels, and the corresponding structures on the protrusion edges 23 are substantially identical to the corresponding structures on the protrusion edges 22, and are not described in detail herein.

As shown in more detail in FIGS. 3C-4B, the protrusion edge 22 of the base 2 is provided with pocket 221 at a position corresponding to the connecting parts 32. The pocket 221 opens to the top and the inside of the protrusion edge 22. A base engaging part 222 extends integrally from the bottom surface of the pocket 221, wherein when the side plate 3 is hinged to the base 2, the base engaging part 222 engages with the side plate engaging part 33. The base engaging part 222 is located at or near the inside of the protrusion edge 22 of the base. The base engaging part 222 includes two columns 225 spaced apart from each other and extending integrally from the bottom surface of the pocket 221. The tops of the two columns are integrally formed with a connecting rod 224. Both sides of the connecting rod 224 serve as an engaging structure, that is, the base engaging part 222 is substantially T-shaped. A guiding hole 229 is defined between the two columns 225 of the base engaging part 222 and the connecting rod 224. When the side panel 3 is mounted to the base 2, the guiding part 36 on the side panel passes through the guiding hole 229 to assist in the mounting of the side panel.

A limiting protrusion 223 protruding inwards is formed on the top of the side surface, facing the inner side of the folding box, of the pocket 221. When the side panel 3 is mounted to the base, the connecting rod 38 on the side panel 3 is located below the limiting protrusion 223 and is blocked by the limiting protrusion 223 without being disengaged from the base 2. A hinge shaft receiving portion 226 and a limiting hanging shoulder 227 are formed on each side of the pocket 221. When the side panel 3 is mounted to the base, the hinge shaft 34 on the side panel 3 is received in the hinge shaft receiving portion 226 and is rotatable therein. In a state where the side plates are upright, the positioning portion 35 on the end of the hinge shaft 34 of the side plate 3 engages with the hanging shoulder 227, thereby enhancing the connection strength between the side plates and the base, as shown in FIG. 6.

Figure 7:
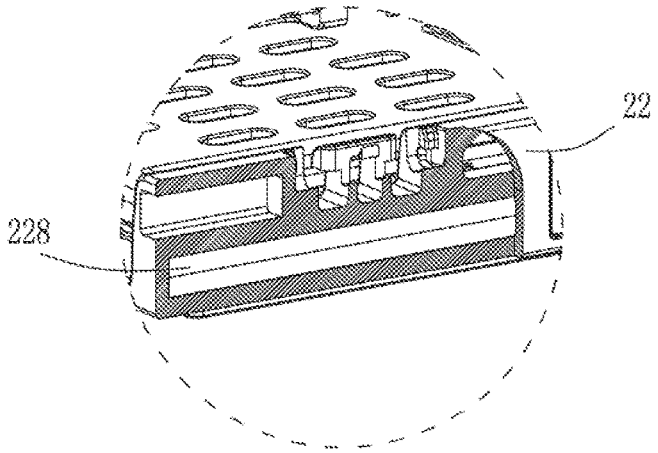
FIG. 7 is an enlarged schematic view of part E in FIG. 5.

FIG. 7 shows an enlarged view of a part of the base 2 with a portion of the base cut away to show the internal structure of the base. As shown in FIG. 7, a cavity 228 is provided in the protrusion edge 22 of the base 2. The cavity 228 is located below the pocket 221. The cavity 228 extends along the length of the protrusion edge 22. The length of the cavity 228 is slightly less than the length of the protrusion edge 22, for example about two walls thicker than the length of the protrusion edge. Preferably, the cavity 228 is a closed cavity. Preferably, the cavity 228 is formed by gas-assisted injection molding.

Figure 5:
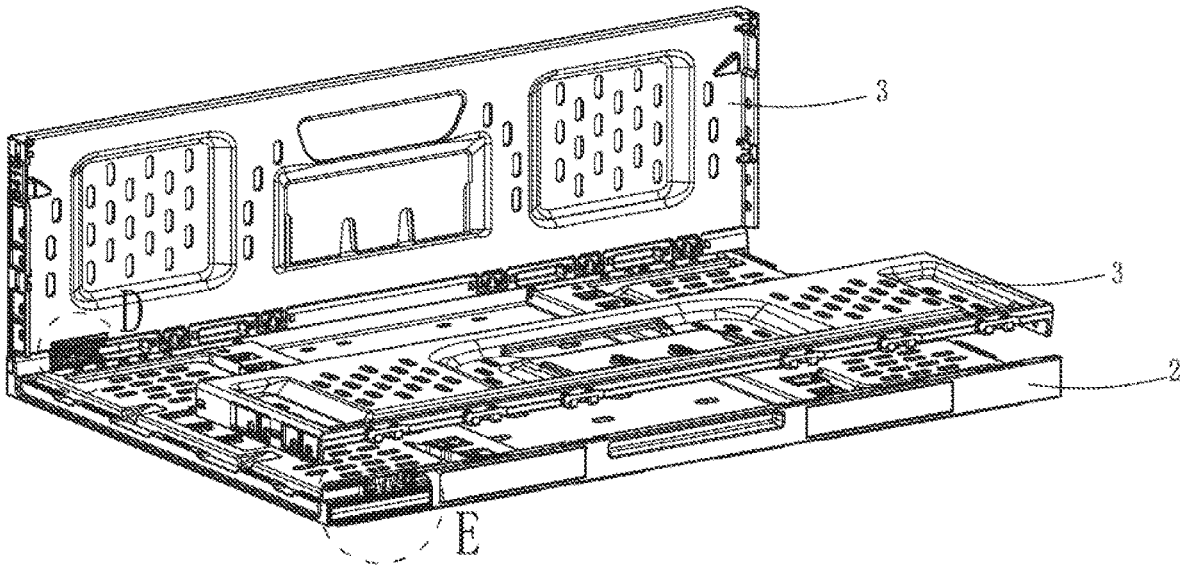
FIG. 5 is a structural schematic view of the folding box of FIG. 1 in one state wherein one long side plate is in an upright state.
Figure 6:
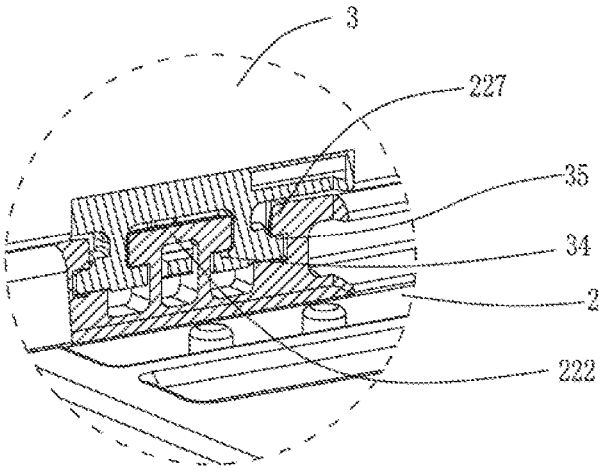
FIG. 6 is an enlarged schematic view of part D in FIG. 5.

FIGS. 5-6 show that the long side panel 3 is connected to the base 2 and is in an upright state. As shown in FIGS. 5 and 6, when the long side panel 3 is connected to the base 2 and is in an upright state, the engaging part 33 at the bottom of the long side panel 3 and the engaging structure 224 on the base are engaged with each other. The hinge shaft 34 at the bottom of the long side plate 3 is located in the hinge shaft receiving portion 226 of the base 2, and the positioning portion 35 formed at the end of the hinge shaft engages with the hanging shoulder 227 of the base, and the guiding part 36 on the long side plate passes through the guiding hole 229 of the base 2.

Figure 8:
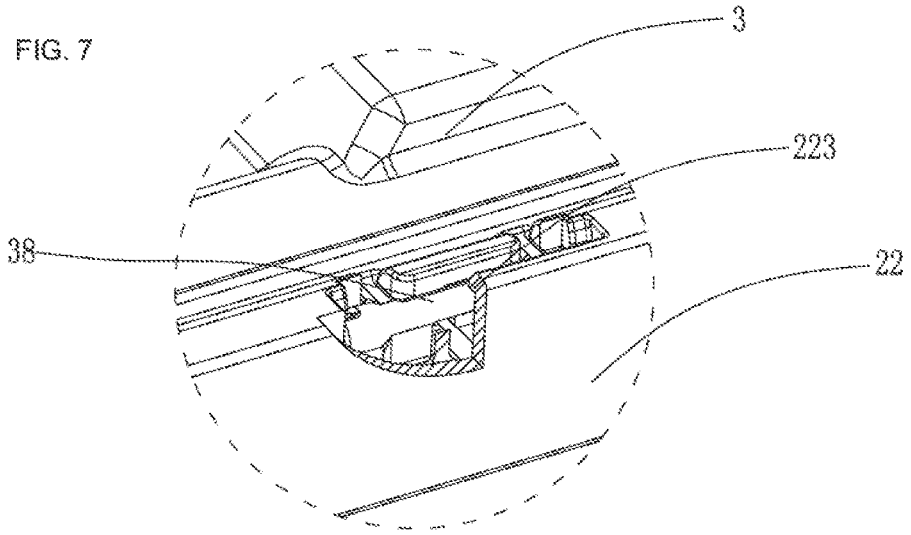
FIG. 8 is a partial view of a side plate of a folding box connected to the base in folded state, with some parts removed for clarity.

FIG. 8 shows that the long side panel 3 is connected to the base 2 and is in a folded state. As shown in FIG. 8, when the side panel 3 is in the folded state, the connecting rod 38 on the side panel, which serves as a limiting feature, is located below the protrusion 223 of the base, thereby preventing the side panel 3 from being disengaged upwardly from the base. In addition, the connecting rod 38 is also located between the base engaging part 222 and the side surface of the pocket of the base facing the inside of the folding box, thereby restricting the side panel from coming out of the base inward or outward when the folding box is in the folded state.

FIGS. 9-12 illustrate structural views of a folding box 10 according to another embodiment of the present invention. The basic components of the folding box are the same as those of the above embodiment, the main difference is the structure of the connecting part of the side plate and the base, and the rest are the same and will not be described in detail herein. As shown in FIGS. 9-12, the lower side of the side panel 30 is provided with an engaging part 301, also referred to as a side panel engaging part 301. The base 20 is provided with a corresponding base engaging part 205, and the side plate engaging part 301 is rotatable around the base engaging part during folding of the side plate 30 relative to the base 20.

Figure 10:
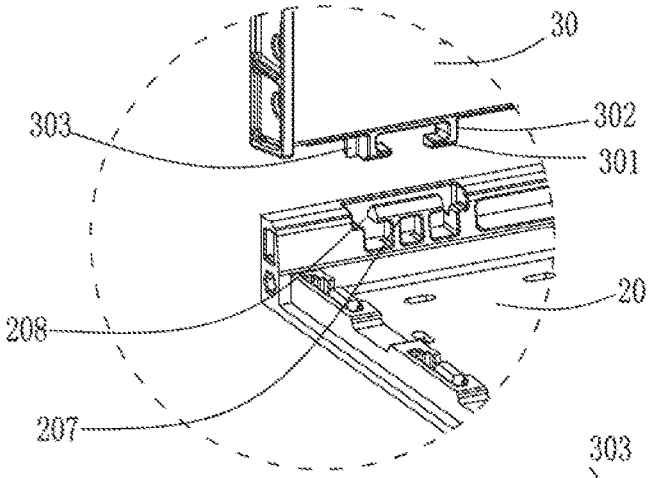
FIG. 10 is a partial enlarged view of the folding box in FIG. 9.
Figure 11:
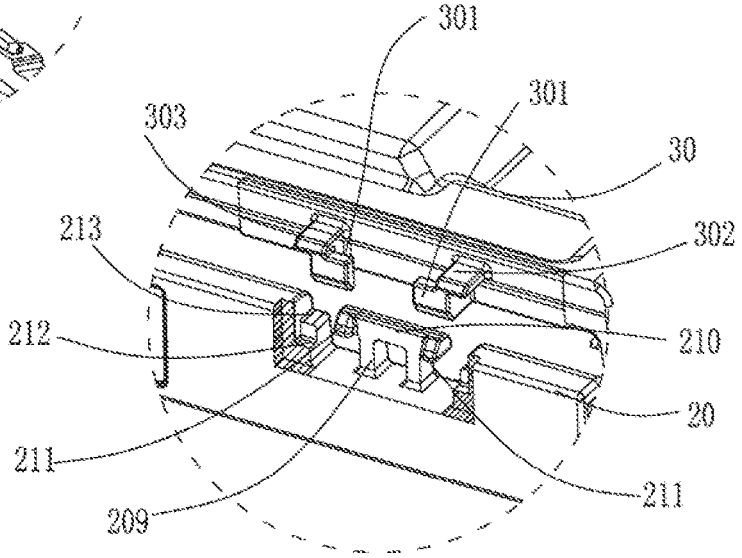
FIG. 11 is another partial enlarged view of the folding box in FIG. 9.

Specifically, as shown in FIGS. 10 and 11, a connecting part 302 integrally extends from the lower side of the side panel 30. The end portion of the connecting part 302 extends from the engaging part 301 on one side along the longitudinal direction of the side plate. The engaging parts extending from one side of the ends of the two adjacent connecting parts 302 extend in opposite directions, and the two adjacent engaging parts form a group of engaging structures. A first side limiting part 303 extends from the other side of the connecting part 302 opposite to the engaging part, and is also referred to as a side plate limiting part. The first side limiting part 303 may be a rib or a protrusion extending downward from the bottom of the side panel.

Figure 9:
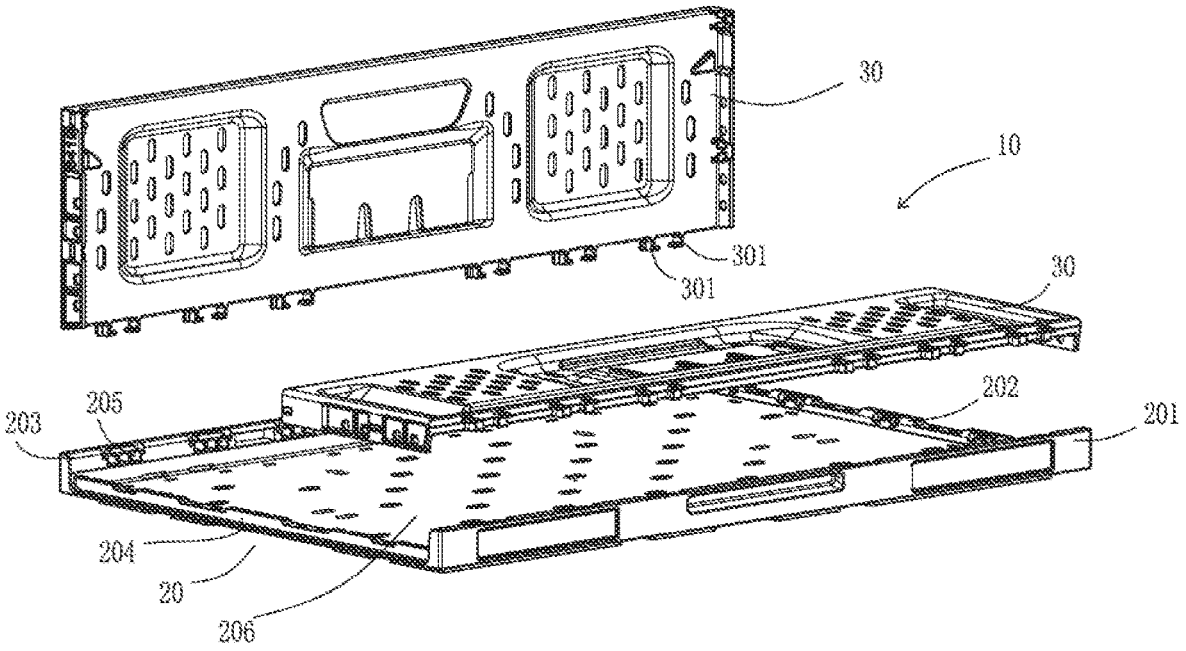
FIG. 9 is an exploded perspective view of the folding box according to another embodiment of this invention, wherein only one base and one long side plate are shown in two different views for sake of clarity.

As shown in FIG. 9, the base 20 includes a body 206. The body 206 is provided with a pair of opposite protrusion edges 201 and 203 and the other pair of opposite protrusion edges 202 and 204 on the periphery thereof. A pair of opposite long side panels are mounted to the protrusion edges 201 and 203 respectively, and a pair of opposite short side panels are mounted to the protrusion edges 202 and 204 respectively. Each protrusion edge is provided with a structure for mating with a corresponding structure on the bottom (i.e., the lower side) of the side panel. Here, a base structure mating with a corresponding structure on the lower side of the long side plate on the protrusion edge 201 is taken as an example for illustration. The corresponding structures on the protrusion edges 202 and 204, that is, the structures mating with the corresponding structures on the lower side of the short side panels, and the corresponding structures on the protrusion edges 203 are substantially identical to the corresponding structures on the protrusion edges 201, and are not described in detail herein.

As shown in more detail in FIGS. 10 and 11, the protrusion edge 201 of the base 20 is provided with a pocket 207 at a position corresponding to the connecting parts 302. The pocket 207 opens to the top and the inside of the protrusion edge 201. A base engaging part 208 extends integrally from the bottom surface of the pocket 221, wherein when the side plate is hinged to the base, the base engaging part 208 engages with the side plate engaging part 301. The base engaging part 208 is located at or near the inside of the protrusion edge 201 of the base. The base engaging part 208 includes two columns 209 spaced apart from each other and extending integrally from the bottom surface of the pocket 207. The tops of the two columns are integrally formed with a connecting rod 210. Both sides of the connecting rod 210 serve as engaging structure. The two columns 209 of the base engaging part 208 and the connecting rod 210 form a T-shaped structure together, that is, the base engaging part 208 is substantially T-shaped.

The side of the connecting rod 210 facing away from the inside of the folding box is formed with a protrusion 211, that is, the protrusion 211 is located between the base engaging part 208 and the side surface of the pocket 207 facing the inside of the folding box.

When the side panel 30 is mounted to the base and is in the folded state, the engaging part 301 on the side panel 30 is located below the protrusion 211 and is blocked by the protrusion 211 to prevent the side panel 30 from being disengaged upward from the base 20.

A limiting groove, or first base limiting part, 212 is also formed on each side of the pocket 207. The limiting groove 212 is an open slot with an opening facing upward. In a state in which the side plates are upright, the first side limiting part 303 of the side plate 30 is inserted into the limiting groove 212, thereby further preventing outward turning of the side plates. A notch 213 is provided on one side, close to the interior of the folding box, of the limiting groove 212. The notch 213 provides a clear space for the limiting groove inserting into or separating from the limiting groove.

Figure 12:
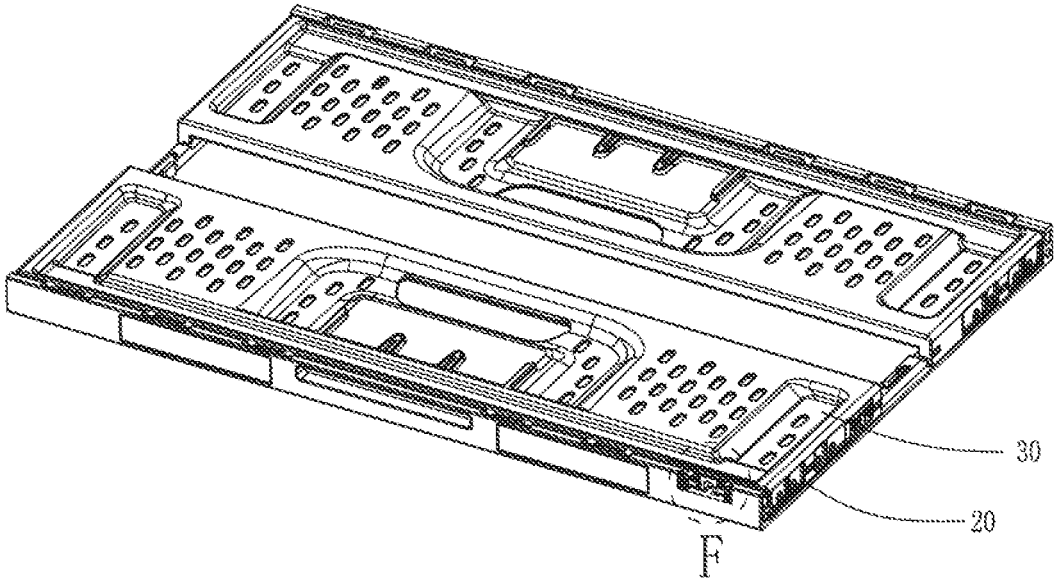
FIG. 12 is a perspective view of the folding box in FIG. 9, wherein the folding box is in folded state.
Figure 13:
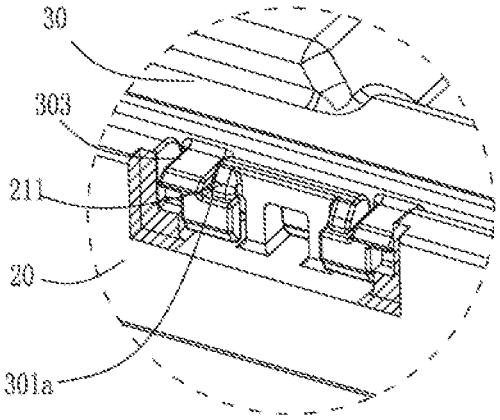
FIG. 13 is an enlarged view of part F in FIG. 12.

FIGS. 12 and 13 show that the long side panel 30 is connected to the base 20 and is in a folded state. As shown in FIGS. 12 and 13, when the side panel 30 is in the folded state, one side 301*a* of the engaging part 301 on the side panel cooperates with the protrusion 211 on the base and is located below the protrusion 211 of the base, thereby preventing the side panel 3 from disengaging from the base upwards.

Figure 14:
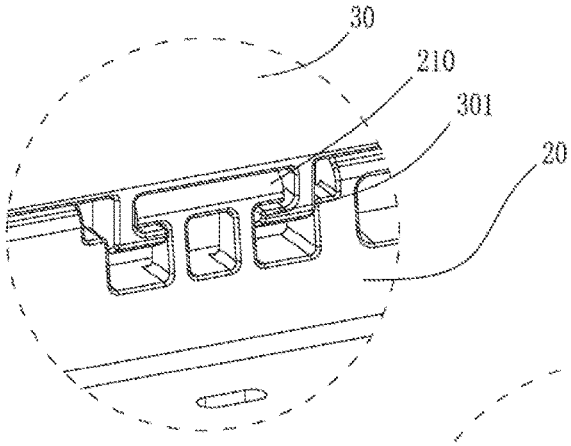
FIG. 14 is a partial enlarged view of the folding box in FIG. 9, wherein the side plate is in upright state.
Figure 16:
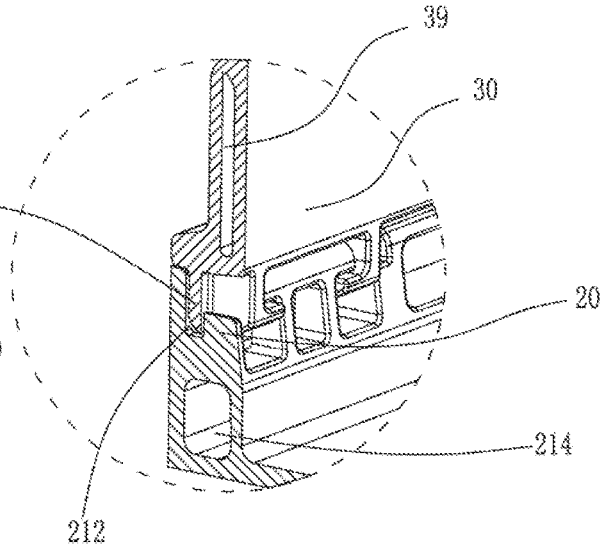
FIG. 16 is another partial enlarged cross-section view of the folding box in FIG. 9, wherein the side plate is in upright state.
Figure 15:
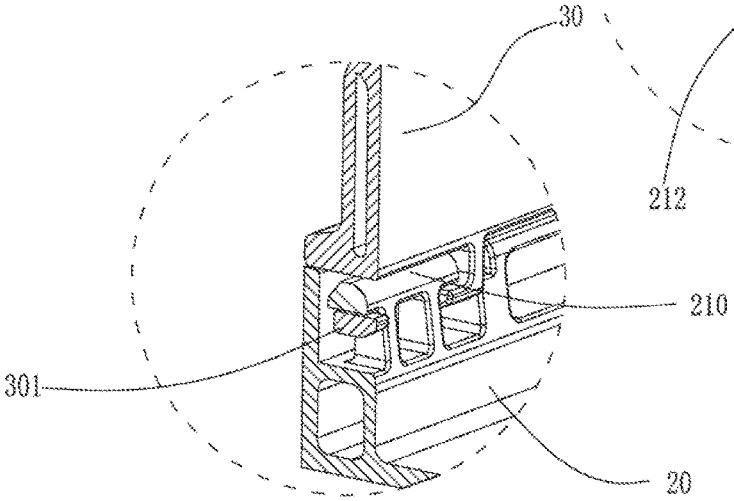
FIG. 15 is a partial enlarged cross-section view of the folding box in FIG. 9, wherein the side plate is in upright state.

FIGS. 14-16 are partial section views which show that the long side panel 30 is connected to the base 20 and is in an upright state. As shown in FIGS. 14 and 16, when the long side panel 30 is connected to the base 2 and is in an upright state, the engaging part 301 at the bottom of the long side panel 30 and the engaging structure 208 on the base are engaged with each other. The limiting part 303 at the bottom of the long side plate 30 is inserted into the limiting groove 212 of the base 20, thereby preventing the side plate 30 from further outward turning.

As shown in FIGS. 15-16, a cavity 214 is provided in the protrusion edge 201 of the base 20. The cavity 214 is located below the pocket 207. The cavity 214 extends along the length of the protrusion edge 201. The length of the cavity 214 is slightly less than the length of the protrusion edge 201, for example about two walls thicker than the length of the protrusion edge. Preferably, the cavity 214 is a closed cavity. Preferably, the cavity 214 is formed by gas-assisted injection molding.

As also shown in FIGS. 15-16, preferably, a third closed cavity 39 is also provided in the bottom protrusion edge of the side panel. The third closed cavity 39 is similar to cavity 214. The third closed cavity 39 extends along the length of the side panel and is a closed cavity. Preferably, the third closed cavity 39 is formed by gas-assisted injection molding.

Figure 17:
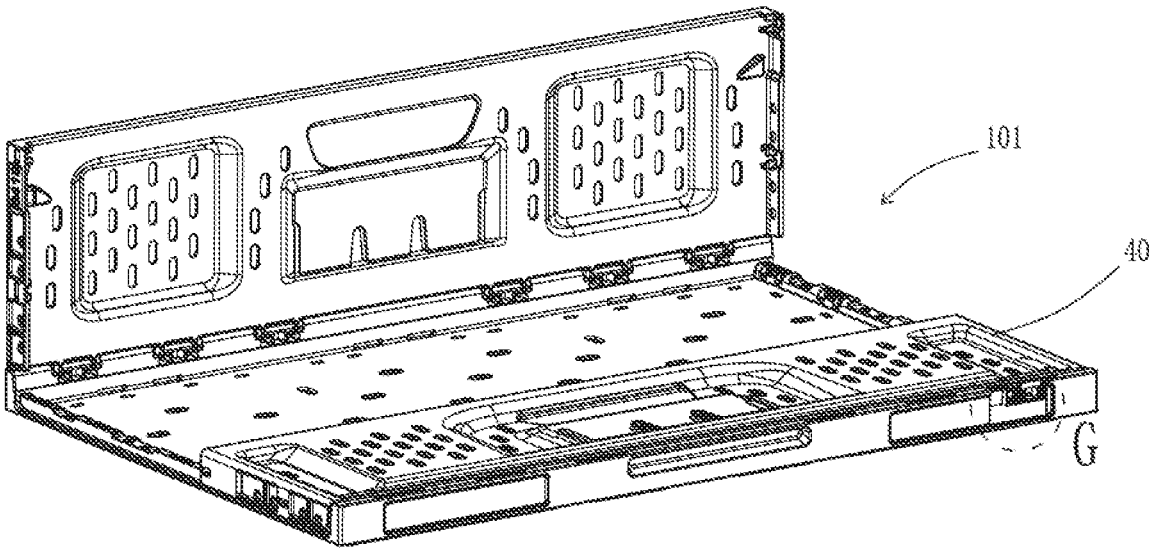
FIG. 17 is a perspective view of a variant of the folding box of FIG. 9, wherein one side plate is in an upright state and the other side plate is in a folded state.
Figure 18:
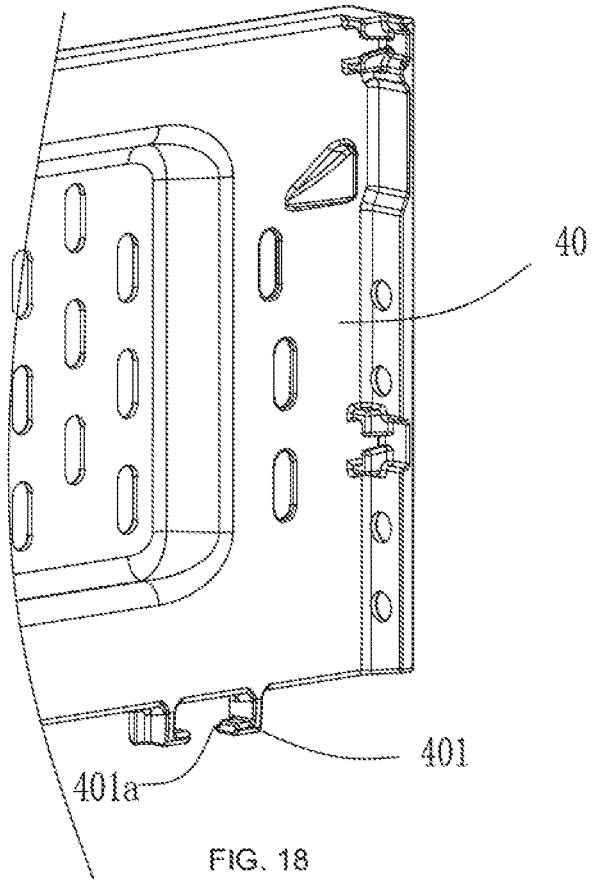
FIG. 18 is a perspective view of the long side plate of the folding box in FIG. 17, only one part is shown for clarity.
Figure 19:
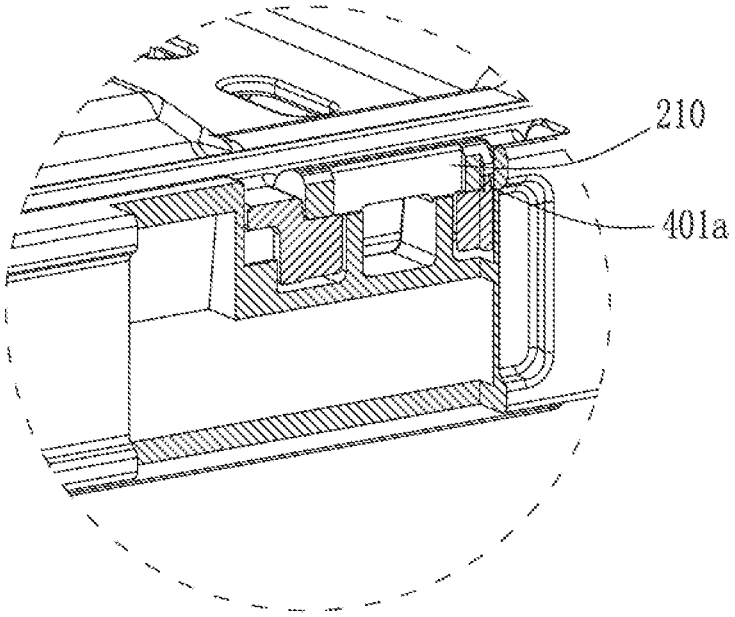
FIG. 19 is an enlarged view of part G in FIG. 17.

FIGS. 17-19 are structural views showing a variant of the folding box shown in FIG. 9. This variant is different from the folding box shown in FIG. 9 in that the engaging part 401 at the bottom of the side plate 40 of the folding box 101 of the present embodiment is different from the engaging part 301 shown in FIG. 9, and the rest are the same and will not be described further. As shown in FIG. 18, the engaging part 401 of the side plate 40 further includes a limiting part 401*a* extending from the body of the engaging part. The limiting part 401*a* is arranged such that the limiting part 401*a* engages with the side panel engaging part in a state where the side panel is folded, so as to prevent the side panel engaging part 401 from being disengaged from the base in a direction toward the inside of the folding box. It should be understood that the size of the engaging part 401 can also be made larger to achieve the same function as the above-described limiting part 401*a*.

Figure 20:
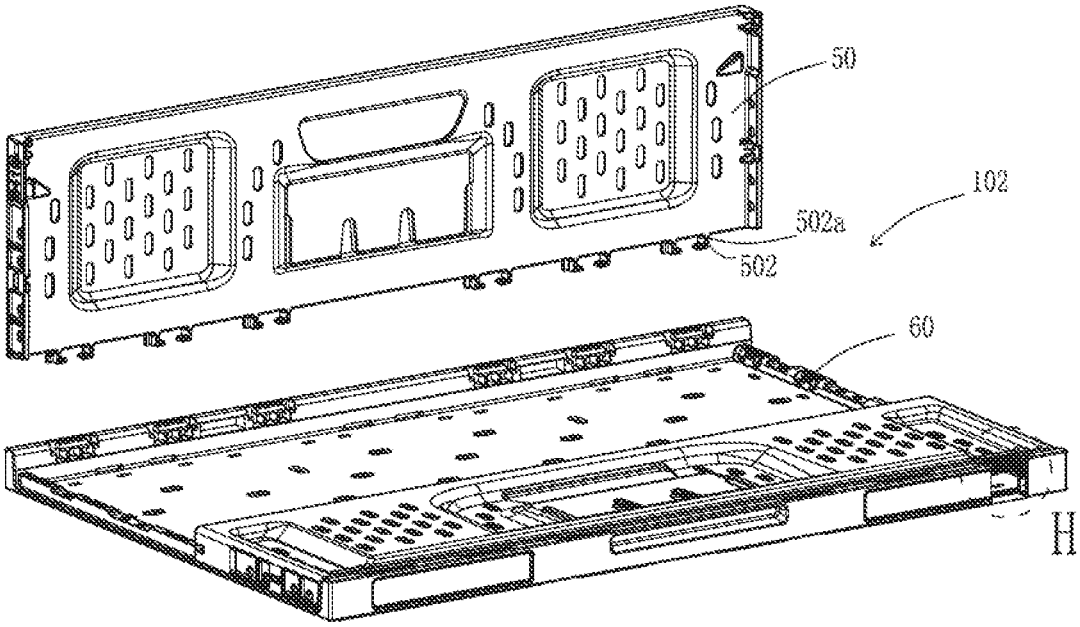
FIG. 20 is a perspective view of another variant of the folding box of FIG. 9, wherein one side plate is in an upright state and the other side plate is in a folded state.
Figure 21:
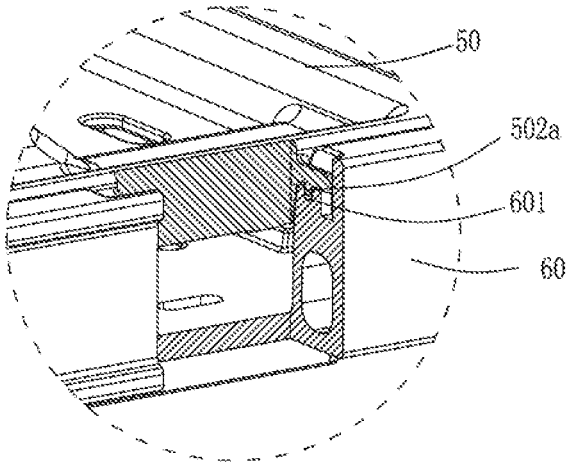
FIG. 21 is an enlarged view of part H in FIG. 20.

FIGS. 20-21 are structural views showing another variant of the folding box shown in FIG. 9. This variant is different from the folding box shown in FIG. 9 in that the engaging part 502 at the bottom of the side plate 50 of the folding box 102 of the present embodiment is different from the engaging part 302 shown in FIG. 9, and the base 60 is provided with a structure for mating with the connecting part, the rest are the same and will not be described further. As shown in FIGS. 20-21, the connecting part 502 of the side panel 50 further includes a limiting protrusion 502*a* extending from one side of the connecting part. The structure of the base 60 is substantially the same as that of the base structure shown in FIG. 9, except that the groove 601 is provided in the pocket at a position corresponding to the limiting protrusion 502*a*, and the rest are the same and will not be described in detail herein. In a state in which the side panels are folded, the limiting protrusions 502*a* cooperate with the base groove 601 to prevent the side panels from being disengaged from the base in a direction toward the inside of the folding box.

It should be understood that the side panels may also be prevented from disengaging from the base in a direction toward the interior of the folding box by other means or structures.

Figure 22:
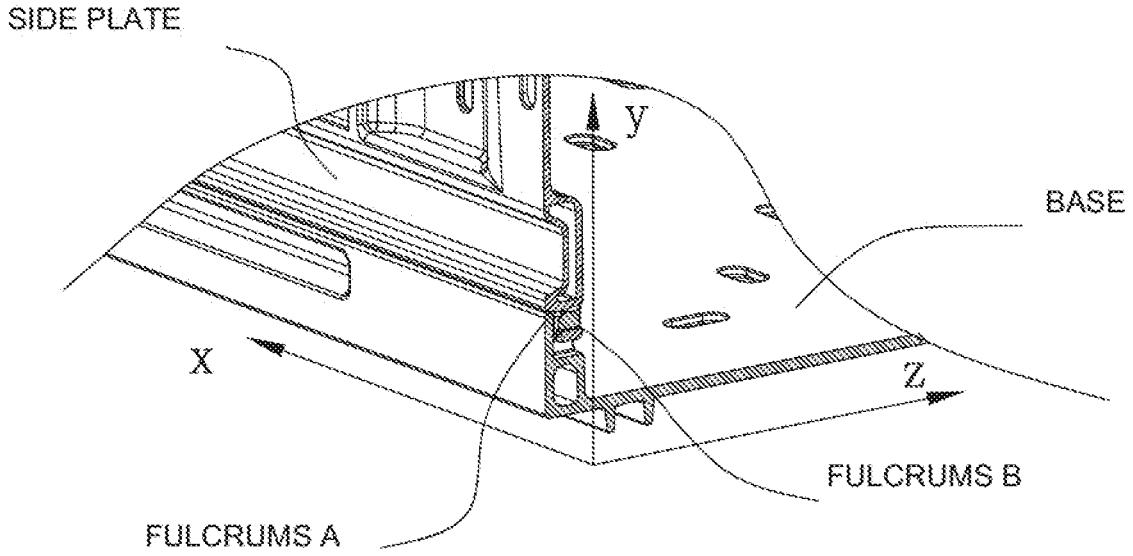
FIG. 22 shows a partial perspective view of a folding box with some parts cut-away to show internal structures.

FIG. 22 shows a partial perspective view of the folding box, one part being cut away to show the internal structure. As shown in FIG. 22, the side plate and the base extend in three directions of x, y, and z. The hinge is arranged along the x-direction of the long side panel. The side panel reinforcement, that is, the cavity has a certain thickness in y-axis which perpendicular to the direction in which the hinge is arranged. The base reinforcement (i.e., the cavity) is arranged in x-direction. The base is arranged with a bearing surface having a radiation area along the x, z axis direction. The hinge joint of the side plate and the base have corresponding fulcrums, and the side plate fulcrums A and B corresponding to the base fulcrums A and B are offset in the Z-axis direction to form a lever so as to resist inward deviation of hinge joint of the side plate and the base when the base sinks due to bearing, and in particular, a first part of the base reinforcing portion is formed.

A reinforcement arranged on the lower edge of the side panel and the base reinforcement form a second part of the base reinforcing portion. In particular, the side plate reinforcement and the base reinforcement at the hinge joint increase the deformation resistance of the hinge portion in the x, y, and z-axis directions (when the base is loaded, the base protrusion edge deviates in y-axis negative direction and the base protrusion edge is forced to deviate in z-axis when the base bearing area sinks).

Figure 23A:
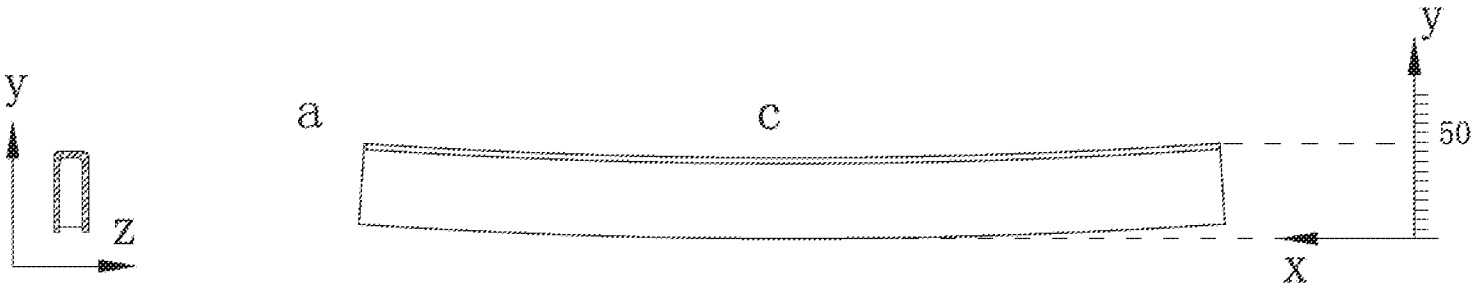
FIGS. 23*a*-23*b* show base protrusion edges with cavities of different sections respectively, and when the base is loaded, the deformations of the base protrusion edge in the y axis direction relative to the x direction and the z direction are shown.
Figure 23B:
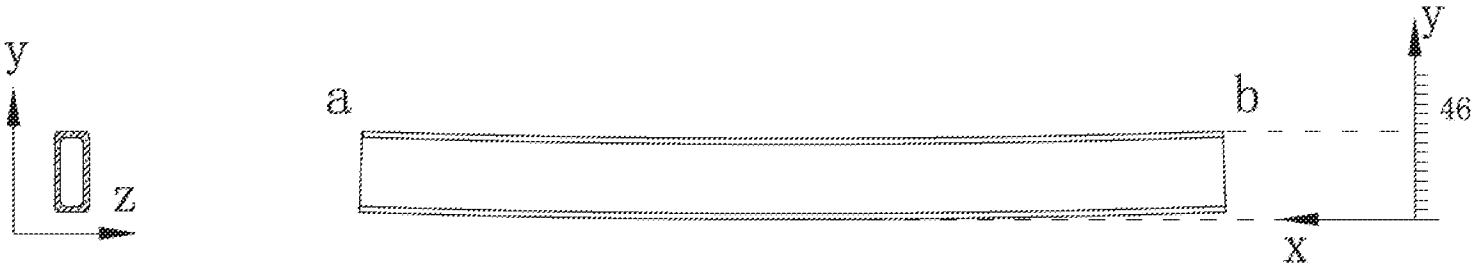

In addition, the closed cavity structure greatly improves the resistance to deformation of the side panels and the base compared to other types of cavities. FIGS. 23*a*-23*b* respectively show the deformation of the base protrusion edge with cavities of different cross-sections, taken along the y-axis with respect to the x, z direction when the base is loaded. FIG. 23*a* is an inverted U-shaped open cavity, and FIG. 23*b* is a closed cavity. When the base protrusion edges are relatively fixed at two ends and a certain pressure is applied in the middle, the protrusion edges with different cavity sections have different bending resistance. At the same pressure, the deformation of the open cavity reaches 50, while the deformation of the closed cavity is only 46. Obviously, the protrusion edge with closed cavity has better resistance to deformation.

Figure 23C:
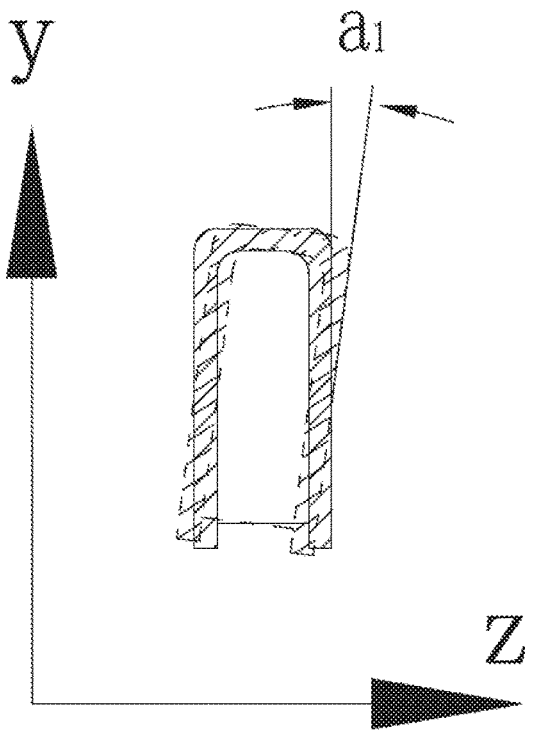
FIG. 23*c* and FIG. 23*d* are schematic diagrams showing local distortion of the base protrusion edge in the yz section when the base sinks under pressure.
Figure 23D:
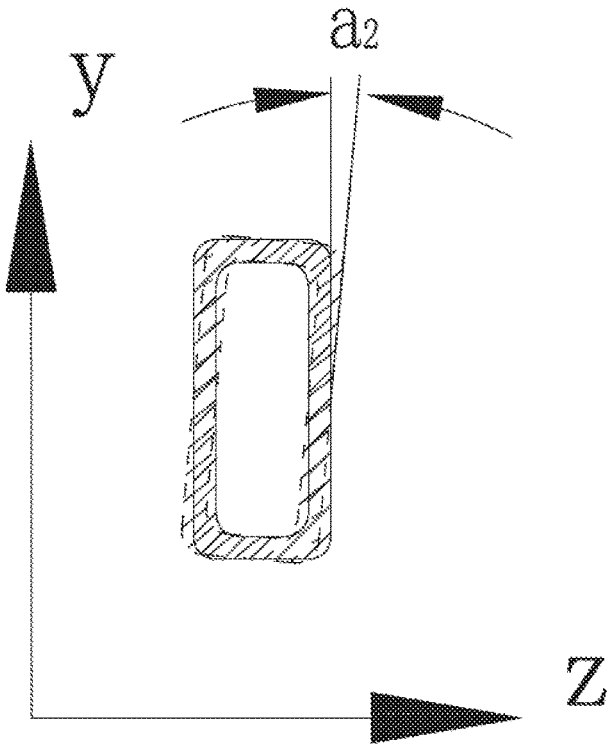

FIG. 23*c* and FIG. 23*d* respectively show a schematic diagrams of the local distortion of the base protrusion edge in the y-z section when the base protrusion edge sinks under the bearing pressure of the base. When the base sinks, compared with the open cavity, the closed cavity has a decreasing tendency of the included angle between the base protrusion edge section and the y-axis, that is a1>a2. It can be seen that the closed base protrusion edge cavity is more resistant to distortion, that is, the base protrusion edge distortion.

In summary, the closed cavity of the base protrusion edge effectively ameliorate the base deformation, thereby enhancing the bearing capacity of the base.

Figure 24:
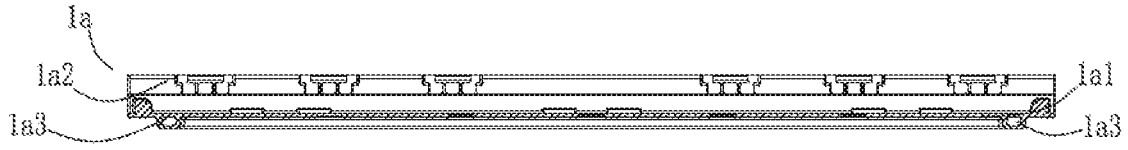
FIG. 24 is a section view of the base of the folding box according to one embodiment of this invention.
Figure 25:
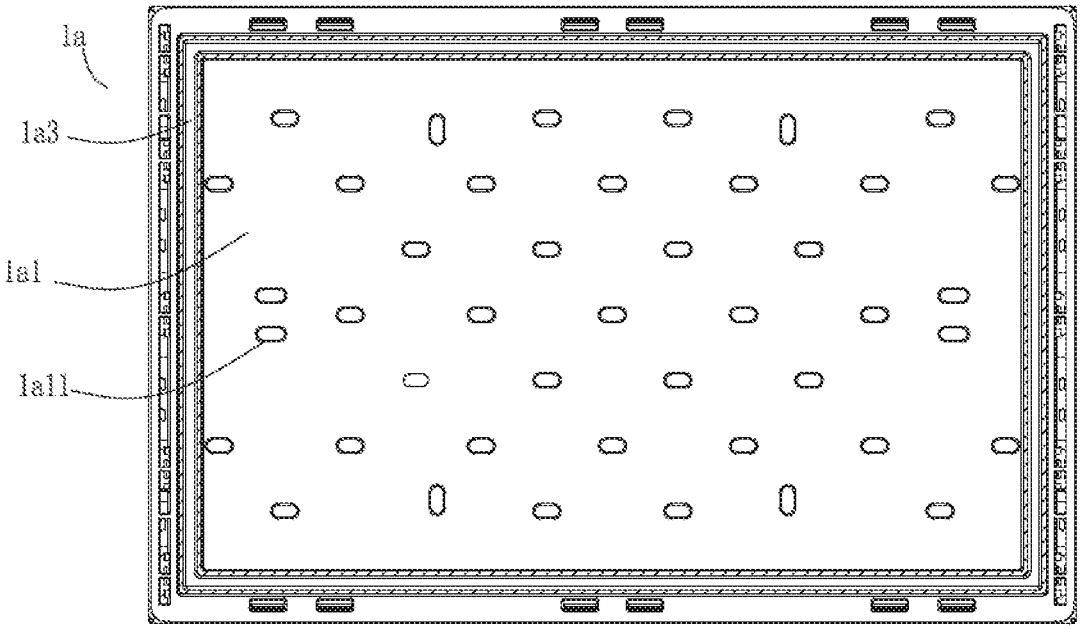
FIG. 25 is a section view of the base of FIG. 24 in another direction.

FIGS. 24-25 illustrate structural views of the base 1*a* of a folding box according to an embodiment of the present invention. As shown in FIGS. 24-25, the base 1*a* includes a plate-shaped body 1a1 and a protrusion edge 1a2. Through holes 1a11 are distributed in the plate-shaped body 1a1. A closed cavities 1a3 are arranged on the periphery of the plate-shaped body 1a1. The closed cavity 1a3 protrudes from the main surface 1a4 of the plate-shaped body and extends parallel to the protrusion edge. The main surface 1a4 faces away from the protrusion edge of the base. By arranging a closed cavities on the periphery of the plate-shaped body, the strength of the base can be greatly improved.

In a variant, the closed cavities 1a3 may be arranged only on one pair of sides of the two opposite sides of the plate-shaped body. The strength of the base can also be increased significantly in such a case.

Preferably, the closed cavity 1a3 is formed by a gas-assisted molding process.

Figure 26:
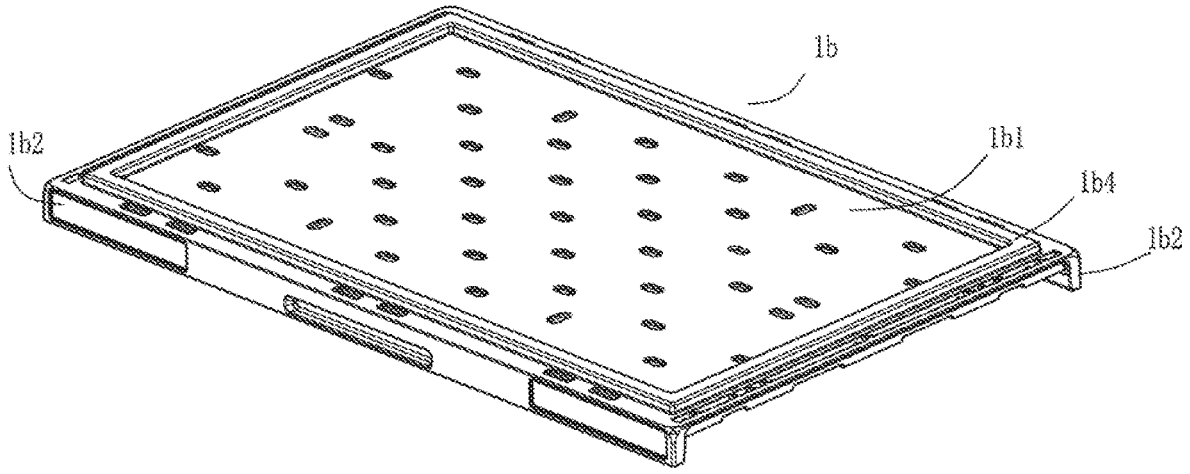
FIG. 26 is a perspective view of the base of the folding box according to another embodiment of this invention.
Figure 27:
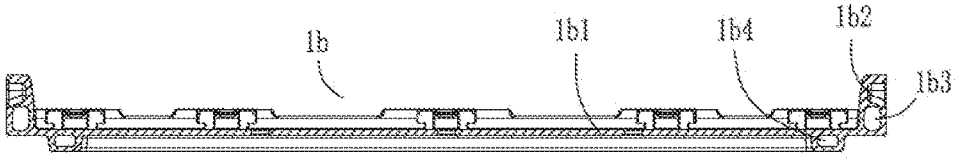
FIG. 27 is a section view of the base in FIG. 26.

FIGS. 26-27 illustrate structural views of the base 1b of a folding box according to another embodiment of the present invention. As shown in FIGS. 26-27, the main difference between this embodiment and the embodiment of FIGS. 24-25 is that the protrusion edge 1b2 of the base 1b and the plate-shaped body 1b1 are both provided with a closed cavities. The rest are basically the same and will not be described in detail here.

A first closed cavity 1b3 is disposed in the protrusion edge 1b2 of the base 1b. The first closed cavity 1b3 is disposed in the at least one pair of the two pairs of opposing protrusion edges and extends along the length of the protrusion edge.

A second closed cavity 1b4 is disposed in the plate-shaped body 1b1. Preferably, the second closed cavity 1b4 disposed in the plate-shaped body is closer to the middle of the plate-shaped body than the first closed cavity 1b3 disposed in the protrusion edge.

Figure 28:
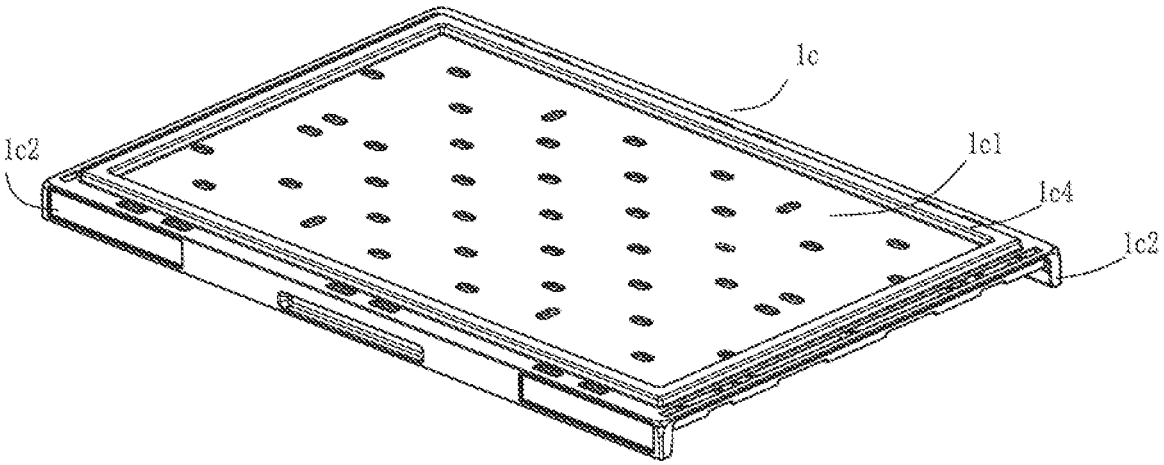
FIG. 28 is a perspective view of the base of the folding box according to yet another embodiment of this invention.
Figure 29:
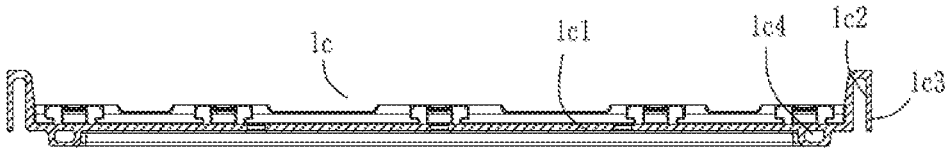
FIG. 29 is a section view of the base in FIG. 28.

FIGS. 28-29 illustrate structural views of the base 1c of a folding box according to yet another embodiment of the present invention. As shown in FIGS. 28-29, the main difference between this embodiment and the embodiment of FIGS. 26-27 is that the cavity 1c3 disposed in the protrusion edge 1c2 is an open cavity, and the cavity 1c4 in the plate-shaped body 1c1 is a closed cavity. The rest are the same and will not be described in detail here.

Figure 30:
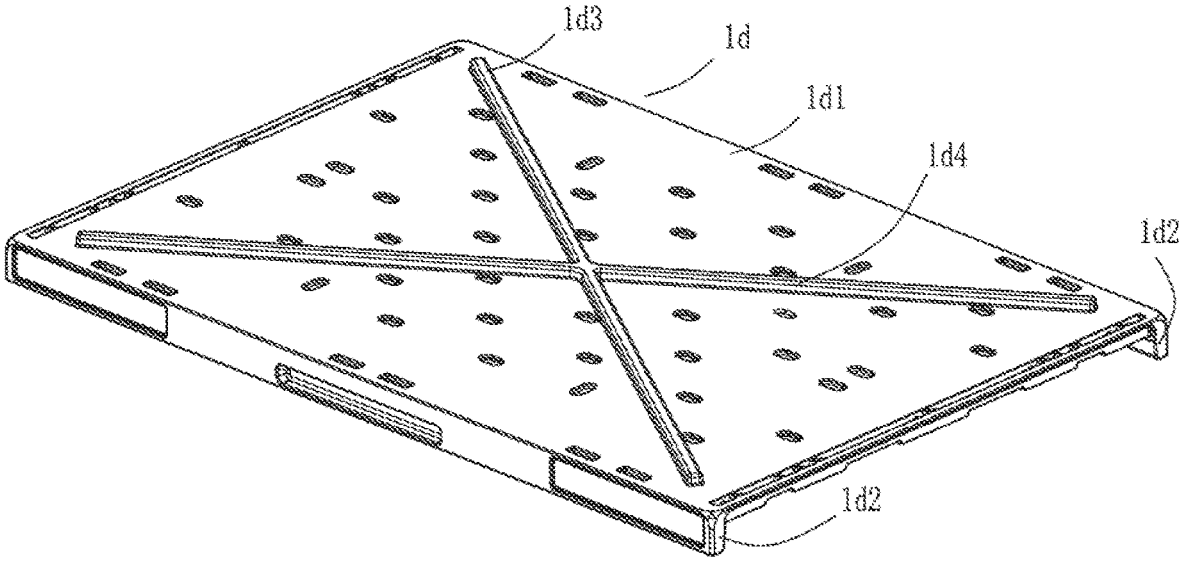
FIG. 30 is a perspective view of the base of the folding box according to yet another embodiment of this invention.
Figure 31:
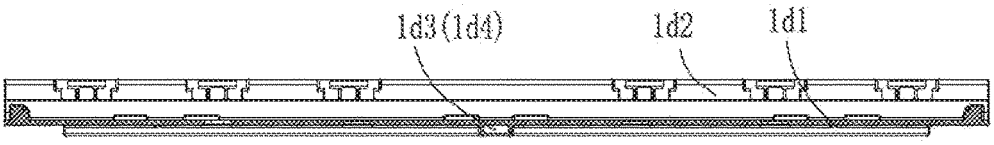
FIG. 31 is a section view of the base in FIG. 30.
Figure 32:
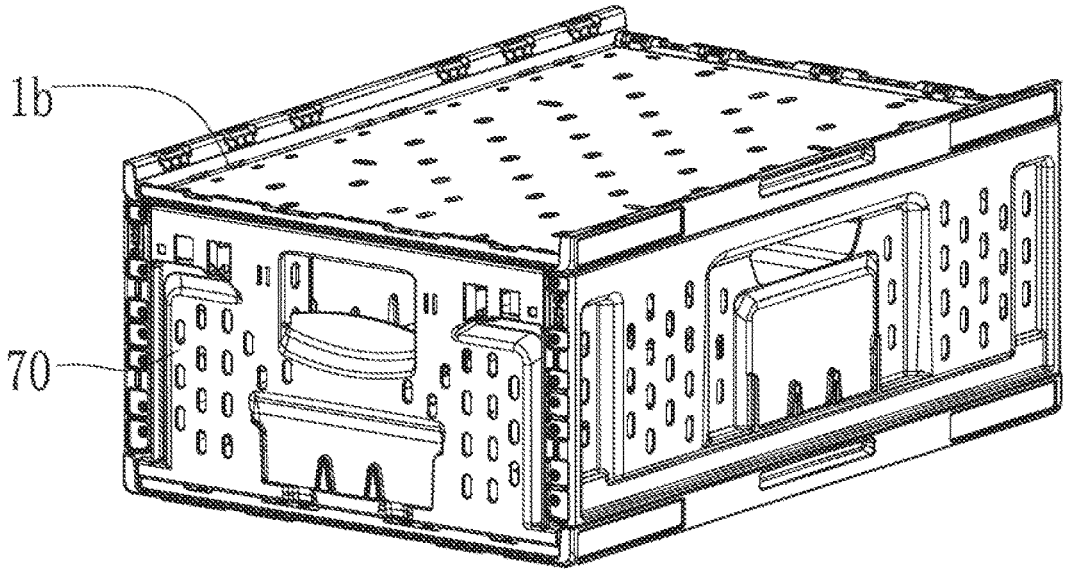
FIG. 32 are structural schematic view of two folding boxes stacked one on another, the side plates of the upper folding box are removed for clarity.
Figure 33:
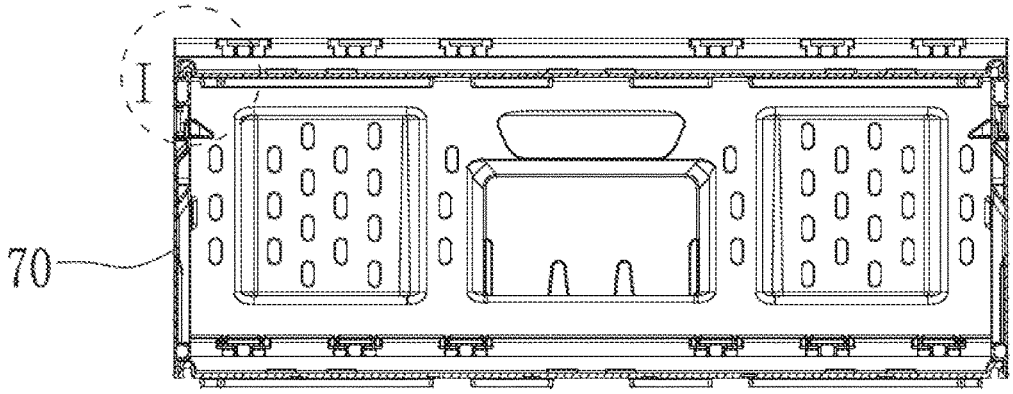
FIG. 33 is a partial front section view of folding boxes stacked one on another in FIG. 32.
Figure 34:
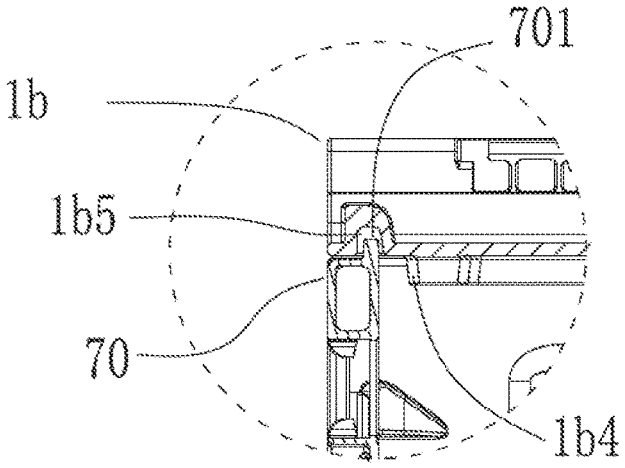
FIG. 34 is a partial enlarged view of part I of the folding box in FIG. 33.
Figure 35:
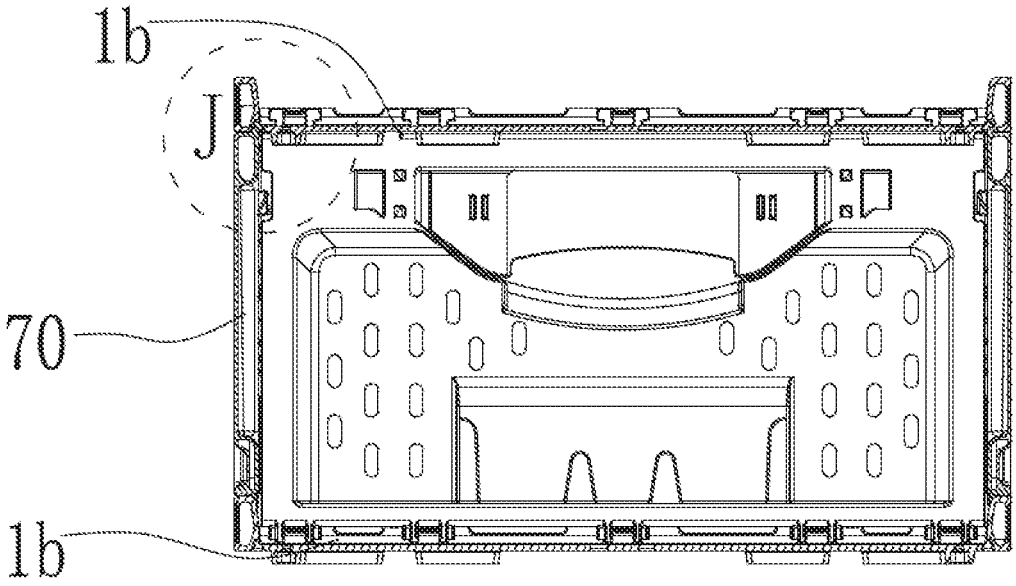
FIG. 35 is a partial side section view of folding boxes stacked one on another in FIG. 32.
Figure 36:
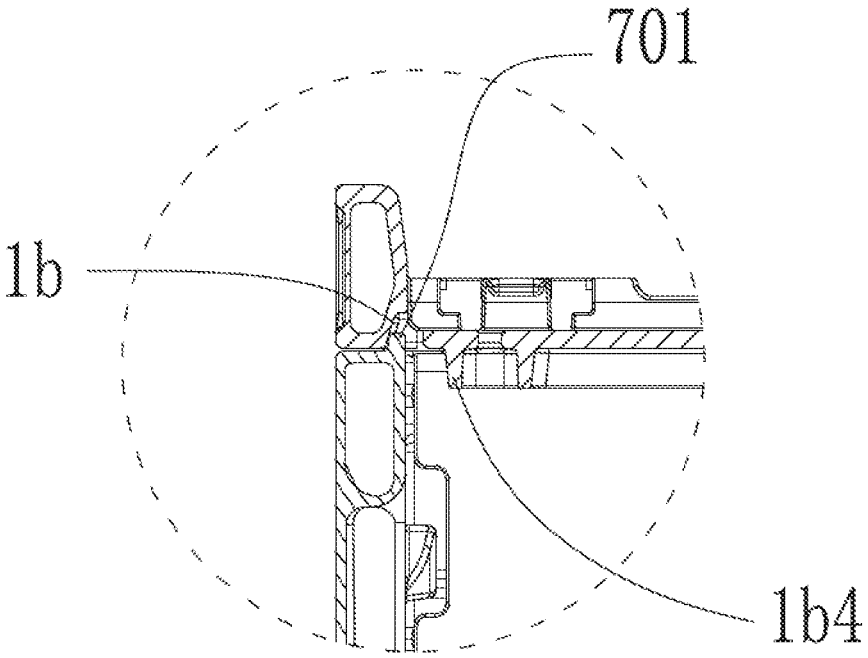
FIG. 36 is an enlarged view of part J of the folding box in FIG. 35.

FIGS. 30-31 illustrate structural views of the base 1d of a folding box according to yet another embodiment of the present invention. As shown in FIGS. 30-31, the main difference between this embodiment and the embodiment of FIGS. 24-25 is that the cavity disposed in the plate-shaped body 1d1 of the base 1d is a cross-shaped cavity, that is, a plate-shaped body of the base 1d is provided with two intersecting closed cavities 1d3 and 1d4. The intersection point of the two closed cavities is at the center of the base. The ends of each of the closed cavities extend to the edge of the base. The two closed cavities are communicated to each other. The rest are the same and will not be described in detail here.

It should be understood that the cavity forms and arrangement positions of the plate-shaped body and the protrusion edge of the base in the above embodiments may be combined with each other.

FIGS. 32-36 show structural views of two folding boxes stacked one on another, wherein the bases of the two folding boxes employ a base 1b as shown in FIG. 26 As shown in FIGS. 32-36, the top of the side panel 70 of the folding box is provided with a side panel limiting part 701. The side plate limiting part 701 is a protrusion that protrudes from the top surface of the side plate. The base 1b is provided with a base limiting part 1b5 at the bottom thereof. The base limiting part 1b5 is a groove provided at the periphery of the base. The side plate limiting part 701 and the base limiting part 1b are arranged such that when the two folding boxes are stacked, the base limiting part 1b of the upper folding box cooperates with the side plate limiting part 701 of the lower folding box, thereby the relative position between the base of the upper folding box and the side panel of the lower folding box is fixed. Further, the closed cavity 1b4 of the protruded bottom surface on the base 1b also serves as a limiting part. Thus, when the two folding boxes are stacked one on another, the closed cavity of the upper folding box is inside the side plates of the lower folding box. Thereby, the side panel of the lower folding box is defined between the base limiting part of the upper folding box and the protruded closed cavity. According to the position limitation, the side plates of the folding box can be less deformed when the side plates of the folding box are pressured by goods, and meanwhile, opposite fixed supporting point are formed on two opposite protrusion edges of the base, so in addition to the reinforcement of the cavities at the protrusion edges of the base, a supporting frame for base protrusion edges is formed with in a fixed support manner for resisting downward deformation of the base when loaded, thereby achieving the double reinforcing effect of the side plate and the base.

It should be understood that, in the above embodiments, the hinge manner between the side panel and the base can be that a connecting part is arranged at the bottom of the side plate, and a corresponding base hinging part is arranged on the protrusion edge of the base, so that the hinging part of the side plate is hinged to the hinging part of the base, and the side plate is hinged to the base. The side panel hinging part described above and the side panel engaging part on the above-mentioned connecting part may be the same part or different parts. Similarly, the above-described base hinging part and the above-described base engaging part may be the same part or different parts. In the process of folding the side panel relative to the base, the side panel engaging part can rotate around the base engaging part, the side panel hinging part and the side panel engaging part are the same part, and the above-mentioned base hinging part and the above-mentioned base engaging part are the same part.

According to the folding box of the invention, the connection structure between the side plate and the base of is simple, the engagement strength is high, the size of the base protrusion edge can be relatively small, and the operation is convenient and easy to clean. In addition, the base is provided with a closed cavity, so that the base has better resistance to distortion and deformation in each direction. When the base are heavily loaded, it can better resist the downward depression of the base after being pressed, so as to solve the problem of crushing between the goods due to depression after the base of the box is pressed, and improve the safety and reliability of the transport after the folding box are loaded. In the case of falling and collisions, the stress can be more evenly distributed, thereby increasing the service life of the folding box.

The preferred embodiments of the present invention have been described in detail, but it should be understood that, after reading the above teachings of the present invention, various modifications or modification of the present invention can be made by those skilled in the art. These equivalent forms are also within the scope defined by the claims appended hereto.

The invention claimed is:

1. A folding box, comprising a base and two pairs of opposite side plates, the base having a rectangular plate-shaped body and two pairs of opposite protrusion edges surrounding the periphery of the rectangular plate-shaped body, wherein the two pairs of opposite side plates are hinged to the protrusion edges of the base and are foldable relative to the base, wherein, connecting parts are arranged at the bottom of the side plate, and corresponding base hinging parts are arranged on the protrusion edge of the base, wherein the connecting parts are hinged to the base hinging parts respectively, thus hinging the side plate to the base; and at least one pair of the two pairs of opposite protrusion edges are provided with first closed cavity extending along the length direction of the protrusion edges.

2. The folding box according to claim 1, wherein a plurality of the connecting parts extend from the bottom of the side plate and are spaced apart from each other, and each of the connecting parts is provided with side plate engaging parts; and the protrusion edge of the base is provided with base engaging parts, wherein the base engaging parts are arranged so that when the side plate is hinged to the base, the engaging parts of the base are engaged with the engaging parts of the side plate respectively.

3. The folding box according to claim 2, wherein a pocket is formed in a position corresponding to the connecting part of the protrusion edge of the base, the base engaging part is arranged in the pocket, and the side plate engaging part is arranged such that the side plate engaging part is rotatable around the base engaging part during the side plate is folding relative to the base.

4. The folding box according to claim 1, wherein the bottom of the side plate is further provided with first side plate limiting parts, and open slots are arranged at positions corresponding to the first side plate limiting parts on the base, wherein the first side plate limiting part is engagable with the open slot to prevent the side plate from turning outwards when the side plate is in upright state.

5. The folding box according to claim 1, wherein the rectangular plate-shaped body is provided with second closed cavities, and the second closed cavities protrude from the main surface of the rectangular plate-shaped body.

6. The folding box according to claim 5, wherein the second closed cavities are arranged on the main surface of the rectangular plate-shaped body opposite to the protrusion edges.

7. The folding box according to claim 5, wherein the rectangular plate-shaped body is provided with at least two second closed cavities parallel to one protrusion edge.

8. The folding box according to claim 5, wherein two pairs of opposite second closed cavities are arranged on the periphery of the base.

9. The folding box according to claim 5, wherein two intersected second closed cavities are arranged in the base, and the intersection point of the two second closed cavities are located in the center of the base.

10. The folding box according to claim 1, wherein the bottom of the side plate is internally provided with a third closed cavity extending along the length direction of the side plate.

11. A folding box, comprising a base and two pairs of opposite side plates, wherein the two pairs of opposite side plates are hinged to protrusion edges of the base and are foldable relative to the base, the base having a rectangular plate-shaped body and two pairs of opposite protrusion edges surrounding the periphery of the rectangular plate-shaped body, wherein a plurality of connecting parts spaced apart from each other extend from the bottom of the side plate, and at least one side plate engaging part is arranged at each of two adjacent connecting parts;

pockets are formed in the protrusion edges of the base at positions corresponding to the connecting parts, and at least two base engaging parts are arranged in each pocket, wherein the base engaging part is arranged so that when the side plate is hinged to the base, and the base engaging part is engaged with the corresponding side plate engaging part, and the side plate engaging part is arranged such that the side plate engaging part is rotatable around the base engaging part during the side plate is folding relative to the base; and the bottom of the side plate is further provided with first side plate limiting parts, and open slots are arranged at positions corresponding to the first side plate limiting part on the base, wherein the first side plate limiting parts are engagable with the open slots respectively to prevent the side plate from turning outwards when the side plate is in upright state, wherein the first side plate limiting part is a rib extending from one side opposite to the side plate engaging part of the connecting part in the length direction of the side plate, and the open slot has an opening facing upward and formed in the pocket.

12. The folding box according to claim 11, wherein one side plate engaging part extends from one side of each connecting part, two base engaging parts are arranged in each pocket, and the two base engaging parts together form a T-shaped structure.

13. The folding box according to claim 11, wherein at least one pair of the two pairs of opposite protrusion edges are provided with first closed cavities extending along the length direction of the protrusion edge, and/or the rectangular plate-shaped body is provided with a second closed cavity, and the second closed cavity protrudes from the main surface of the rectangular plate-shaped body.

14. A folding box, comprising a base and two pairs of opposite side plates, wherein the two pairs of opposite side plates are hinged to protrusion edges of the base and are foldable relative to the base, the base having a rectangular plate-shaped body and two pairs of opposite protrusion edges surrounding the periphery of the rectangular plate-shaped body, wherein a plurality of connecting parts spaced apart from each other extend from the bottom of the side plate, and the connecting part is provided with a side plate engaging part, and a hinge shaft extending along the length direction of the side plate is provided on the outer side of the side plate engaging part;

pockets are formed in the protrusion edges of the base at positions, corresponding to the connecting parts, a base engaging part is arranged in the middle of the pocket, and hinge shaft receiving parts are arranged at the two ends of the pocket, wherein the base engaging part is arranged so that when the side plate is hinged to the base, the base engaging part is engaged with the side plate engaging part, and the side plate engaging part is arranged such that when the side plate is folding relative to the base, the side plate engaging part is rotatable around the base engaging part, and the hinge shaft is received in the hinge shaft receiving part and is rotatable around an axis in the hinge shaft receiving part; and the bottom of the side plate is further provided with first side plate limiting parts, and open slots are arranged at positions corresponding to the first side plate limiting part on the base, wherein the first side plate limiting parts are engageable with the open slots to prevent the side plate from turning outwards when the side plate is in upright state, wherein the first side plate limiting part is a rib extending from one side opposite to the side plate engaging part of the connecting part in the length direction of the side plate, and the open slot has an opening facing upward formed in the pocket.

15. The folding box according to claim 14, wherein at least one pair of the two pairs of opposite protrusion edges are provided with first closed cavities extending along the length direction of the protrusion edge, and/or the rectangular plate-shaped body is provided with a second closed cavity, and the second closed cavity protrudes from the main surface of the rectangular plate-shaped body.

16. The folding box according to claim 14, wherein a limiting rod is connected between two side plate engaging parts, wherein a side surface of the pocket of the base which faces the inner side of the folding box is provided with a limiting protrusion facing the inner side of the folding box, wherein the limiting rod cooperates with the limiting protrusion to prevent the side plate from being disengaged from the base when the side plate is in folded state.

* * * * *